US012702261B2

(12) United States Patent
Shin et al.

(10) Patent No.: US 12,702,261 B2
(45) Date of Patent: Aug. 11, 2026

(54) ROBOT CLEANER AND METHOD OF CONTROLLING ROBOT CLEANER

(71) Applicant: LG ELECTRONICS INC., Seoul (KR)

(72) Inventors: Yonggil Shin, Seoul (KR); Inbo Shim, Seoul (KR); Sihwan Moon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 764 days.

(21) Appl. No.: 17/921,052

(22) PCT Filed: Apr. 23, 2021

(86) PCT No.: PCT/KR2021/005150
§ 371 (c)(1),
(2) Date: Oct. 24, 2022

(87) PCT Pub. No.: WO2021/215871
PCT Pub. Date: Oct. 28, 2021

(65) Prior Publication Data

US 2023/0180986 A1 Jun. 15, 2023

(30) Foreign Application Priority Data

Apr. 24, 2020 (KR) ..... 10-2020-0050236

(51) Int. Cl.
*A47L 11/40* (2006.01)

(52) U.S. Cl.
CPC ..... *A47L 11/4011* (2013.01); *A47L 11/4038* (2013.01); *A47L 11/4066* (2013.01); *A47L 2201/04* (2013.01)

(58) Field of Classification Search
CPC ..... A47L 11/4011; A47L 11/4038; A47L 11/4066; A47L 2201/04
USPC ..... 701/400
See application file for complete search history.

(56) References Cited

U.S. PATENT DOCUMENTS

| | | | | |
|---|---|---|---|---|
| 8,452,450 | B2 | 5/2013 | Dooley et al. | |
| 11,803,190 | B2 * | 10/2023 | Lee | G01S 17/48 |
| 12,075,957 | B2 * | 9/2024 | Chen | A47L 11/4013 |
| 12,090,650 | B2 * | 9/2024 | Romanov | A47L 11/4036 |

(Continued)

FOREIGN PATENT DOCUMENTS

| | | | |
|---|---|---|---|
| CN | 108102539 | A | 11/2016 |
| CN | 108814449 | A | 11/2018 |

(Continued)

*Primary Examiner* — Gertrude Arthur Jeanglaude
(74) *Attorney, Agent, or Firm* — Birch, Stewart, Kolasch & Birch, LLP

(57) ABSTRACT

The present disclosure relates to a method of controlling a robot cleaner including a pair of rotary plates having lower sides to which mops facing a floor surface are coupled, the robot cleaner being configured to move by rotating the pair of rotary plates, the method including: a first forward movement step of moving the robot cleaner forward from a starting point toward a predetermined target point; a first rotation step of rotating the robot cleaner; a second forward movement step of moving the robot cleaner forward after the first rotation step; and a second rotation step of rotating the robot cleaner after the second forward movement step, such that the floor surface may be repeatedly cleaned only by the forward movement and the rotation.

7 Claims, 28 Drawing Sheets

(56) References Cited

U.S. PATENT DOCUMENTS

| | | | | |
|---|---|---|---|---|
| 2004/0049877 | A1* | 3/2004 | Jones | A47L 9/009 15/319 |
| 2006/0253224 | A1* | 11/2006 | Tani | G05D 1/0272 701/23 |
| 2011/0004342 | A1* | 1/2011 | Knopow | G05D 1/0242 701/25 |
| 2011/0202175 | A1 | 8/2011 | Romanov et al. | |
| 2015/0251318 | A1 | 9/2015 | Lv | |
| 2019/0038105 | A1* | 2/2019 | Park | A47L 9/28 |
| 2019/0038106 | A1 | 2/2019 | Jang et al. | |
| 2019/0061156 | A1* | 2/2019 | Li | G05D 1/027 |
| 2019/0150692 | A1 | 5/2019 | Yoon et al. | |
| 2019/0290089 | A1 | 9/2019 | Johnson et al. | |

FOREIGN PATENT DOCUMENTS

| | | | |
|---|---|---|---|
| CN | 109464075 | A | 3/2019 |
| CN | 110507260 | A | 11/2019 |
| CN | 110764497 | A | 2/2020 |
| JP | 8-215116 | A | 8/1996 |
| KR | 10-2009-0104388 | A | 10/2009 |
| KR | 10-2014-0045743 | A | 4/2014 |
| KR | 10-1578882 | B1 | 12/2015 |
| KR | 10-1622737 | B1 | 5/2016 |

* cited by examiner

[FIG. 1]
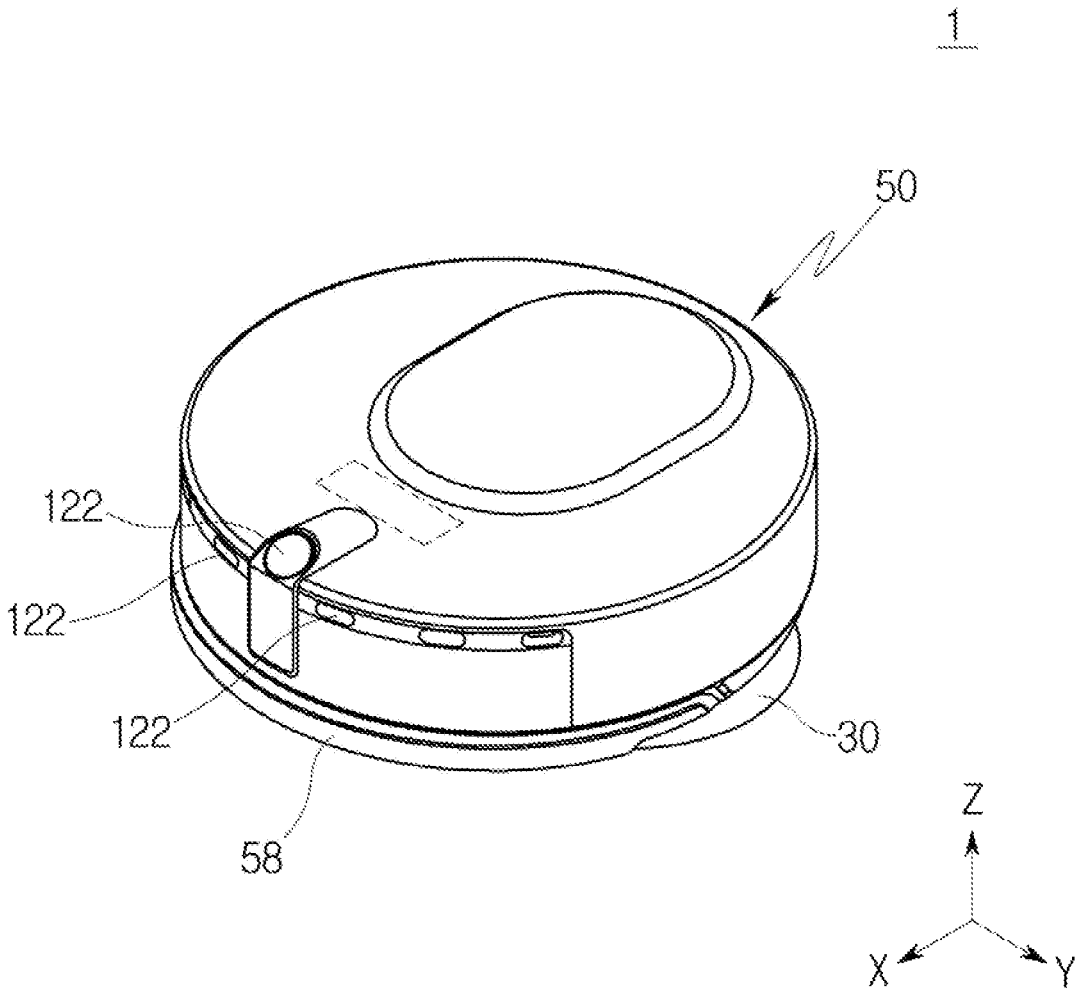

[FIG. 2]
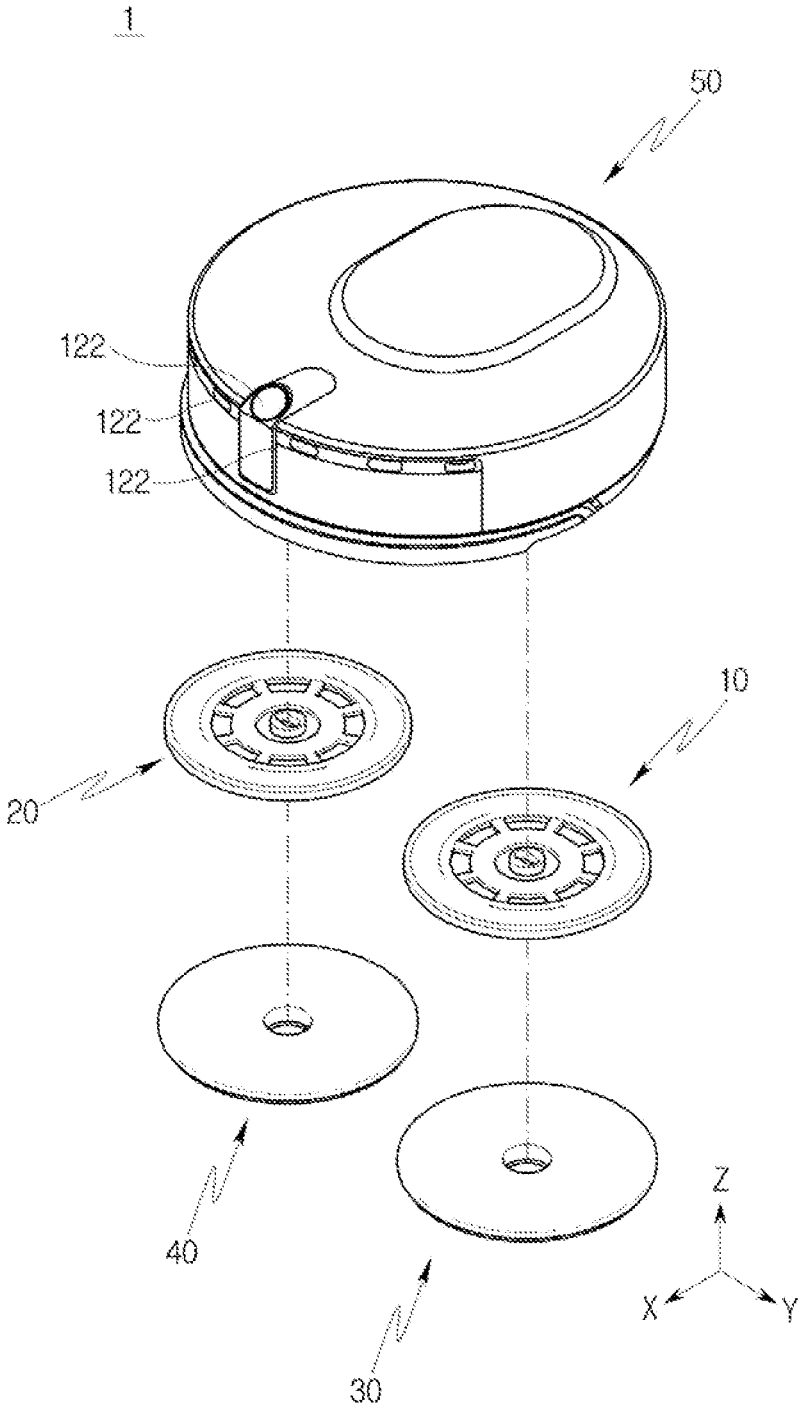

[FIG. 3]
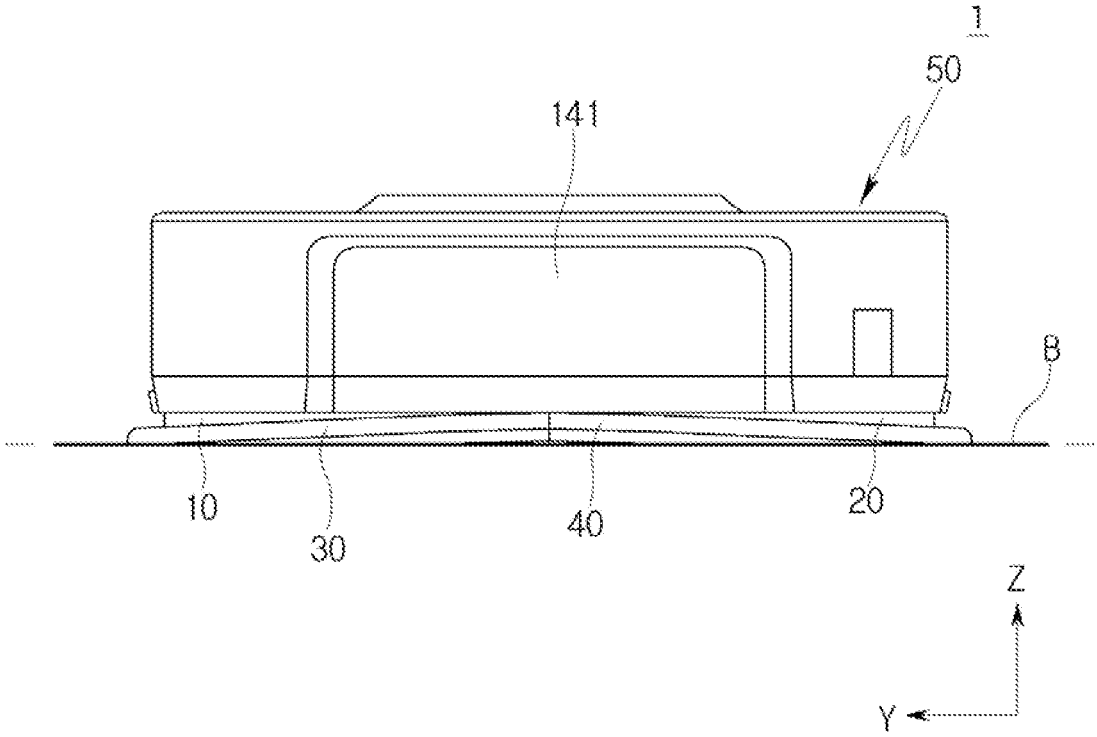

[FIG. 4]
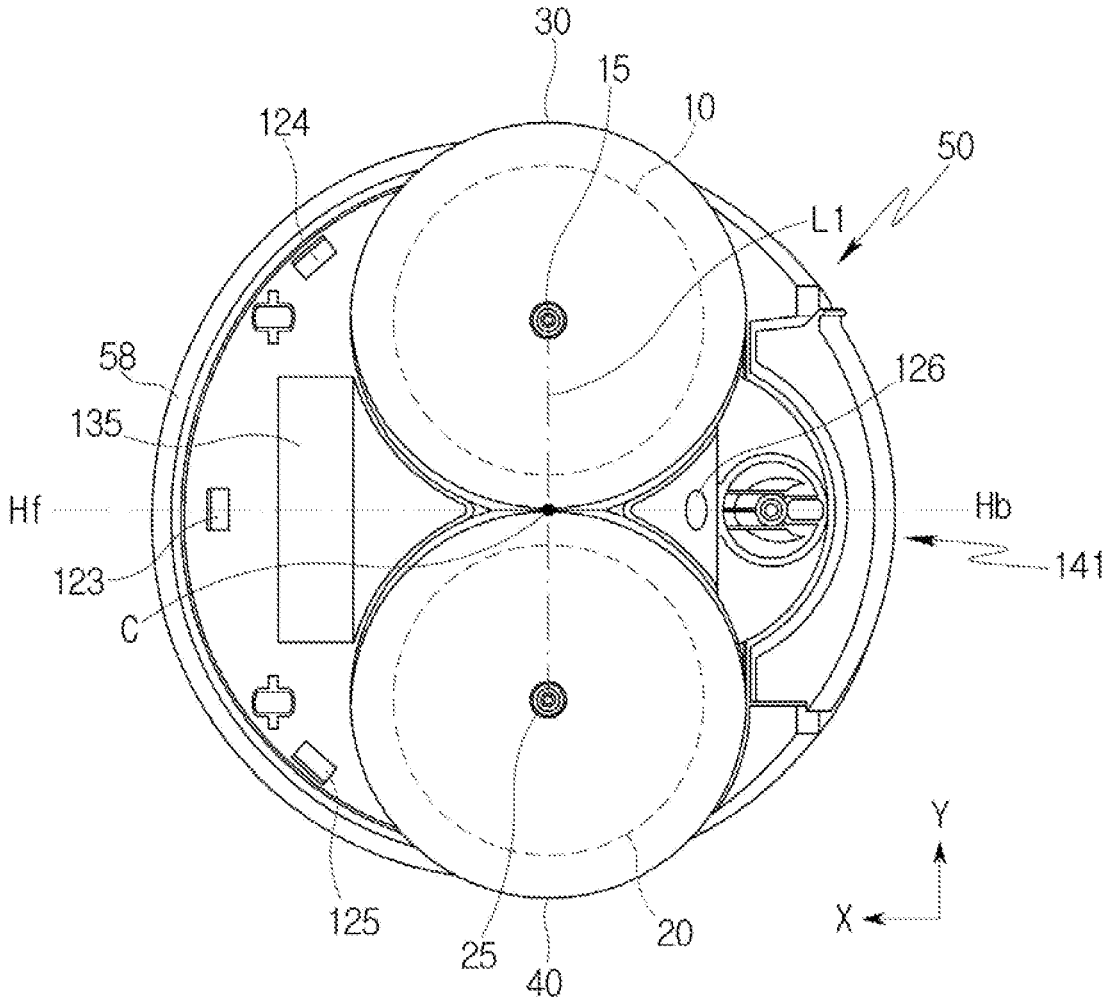

[FIG. 5]
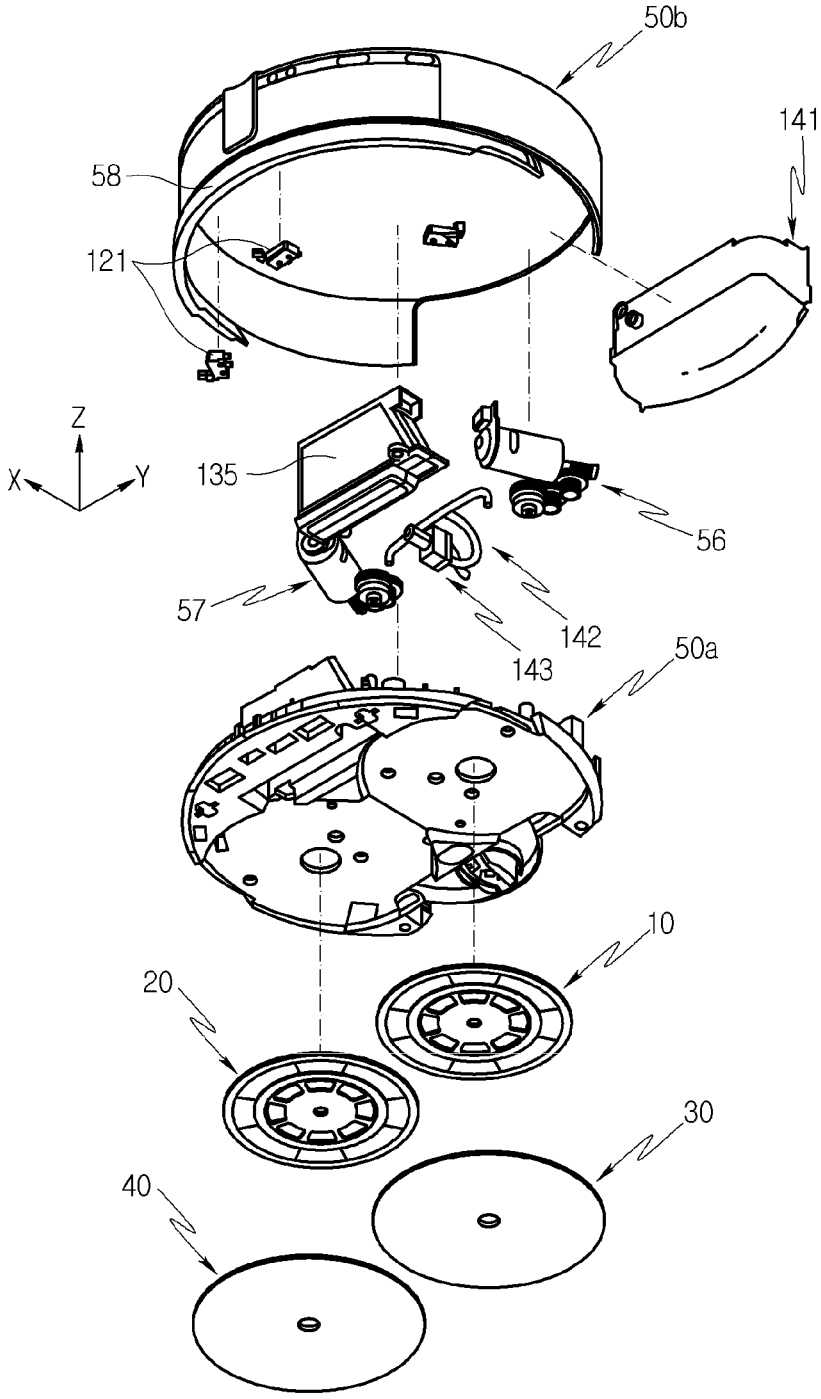

[FIG. 6]
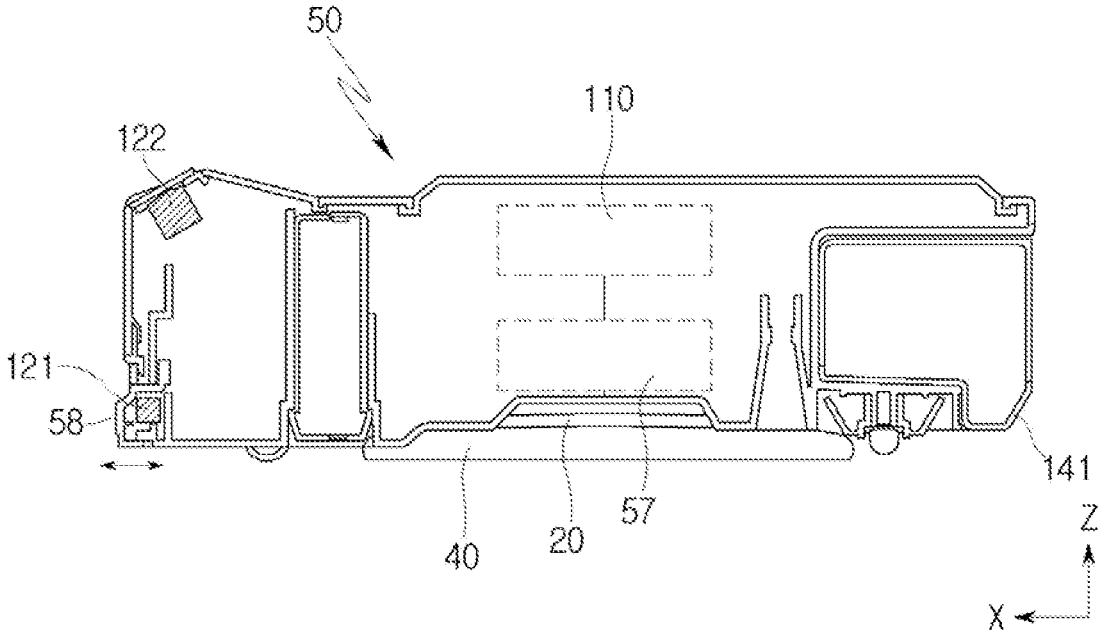

[FIG. 7]
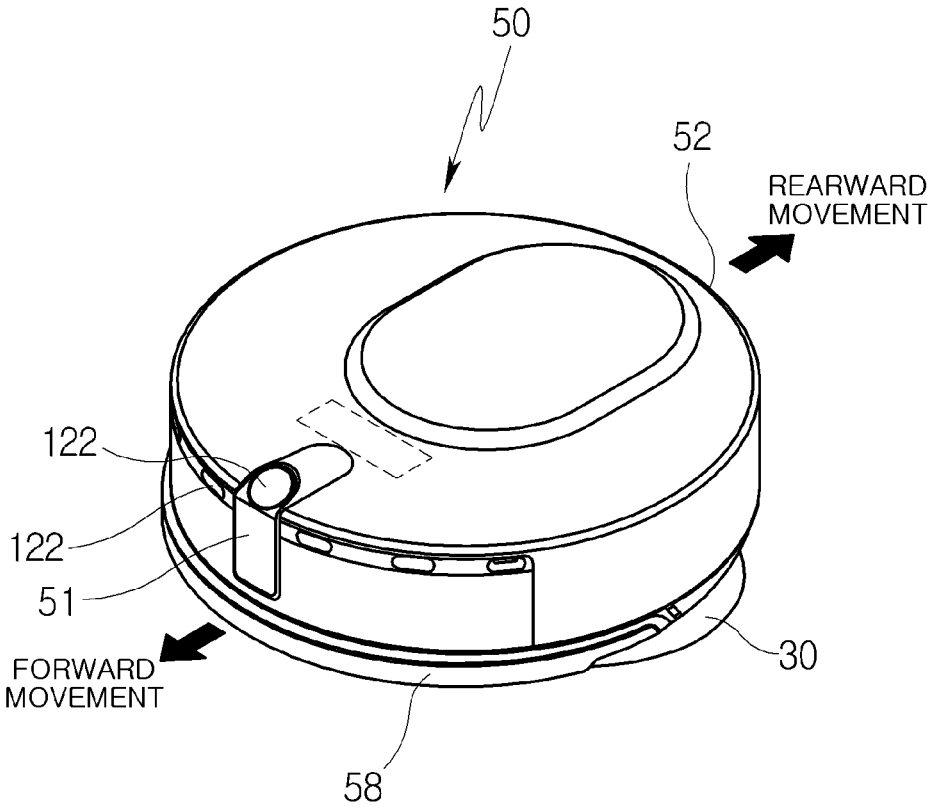

[FIG. 8]
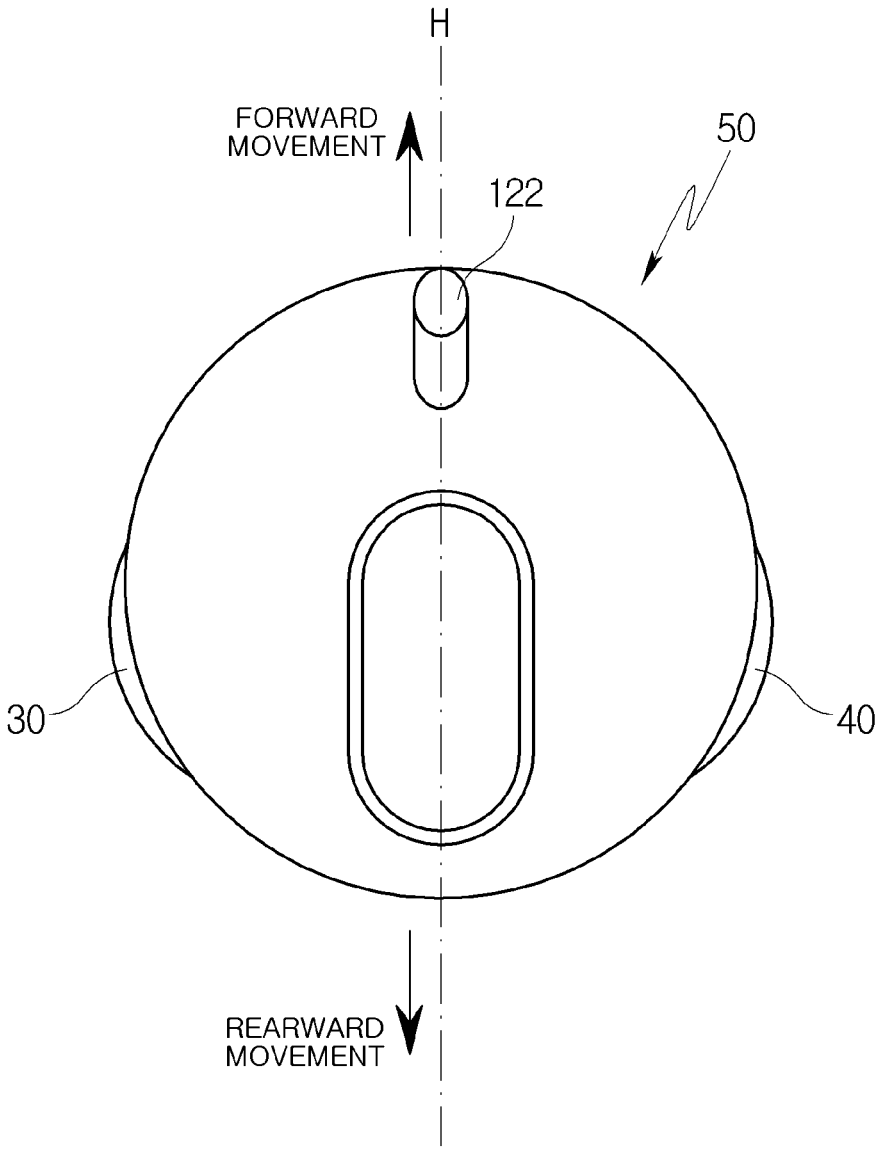

[FIG. 9]
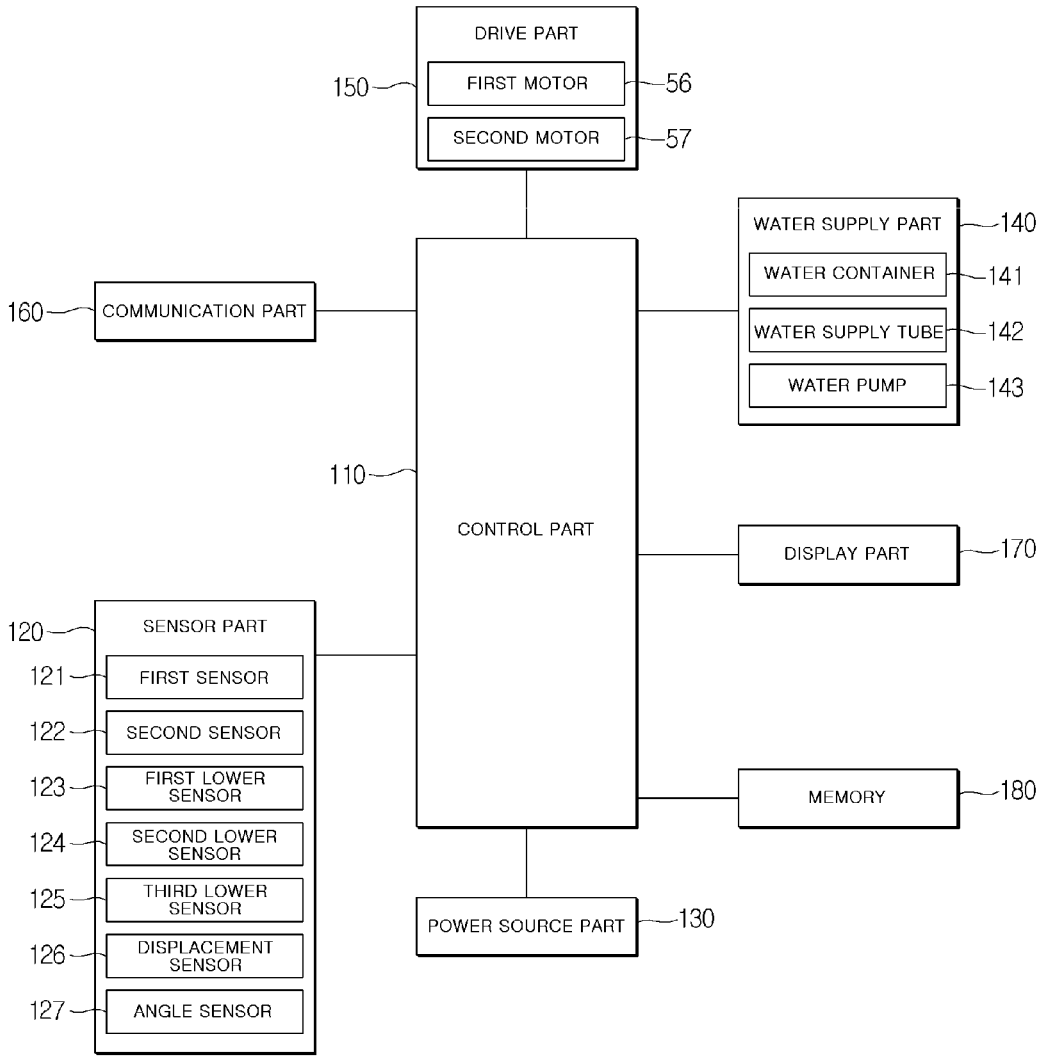

[FIG. 10]
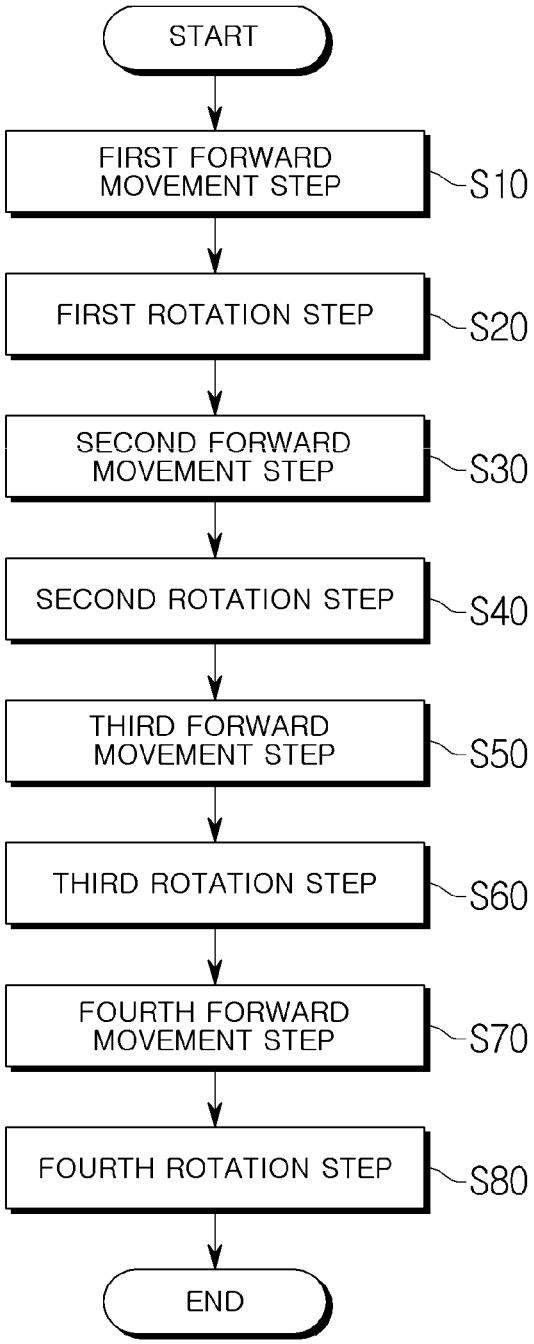

[FIG. 11A]
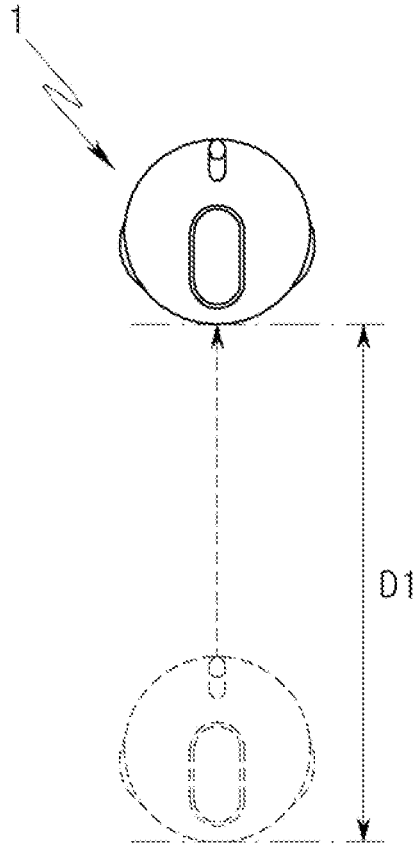

[FIG. 11B]
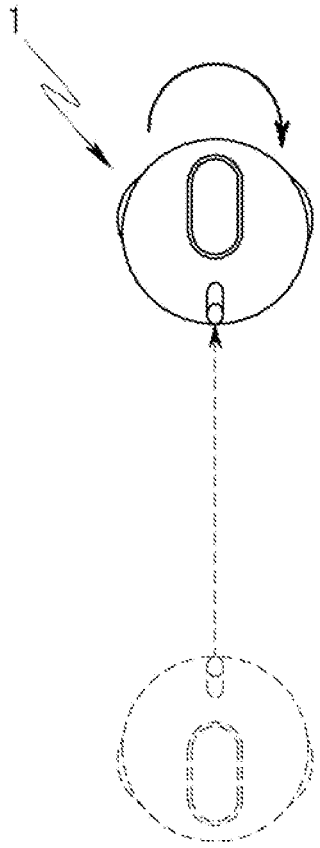

[FIG. 11C]
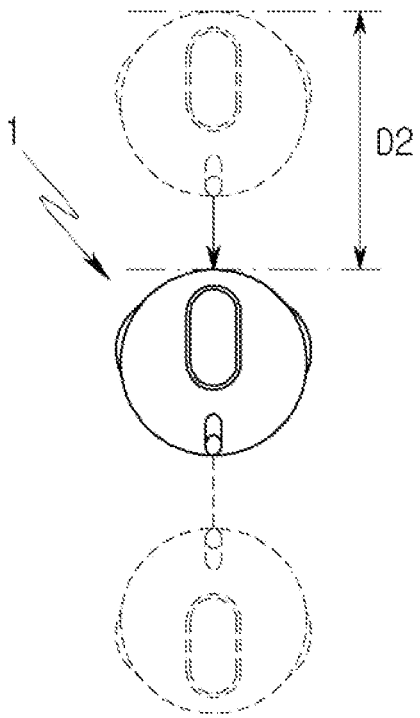

[FIG. 11D]
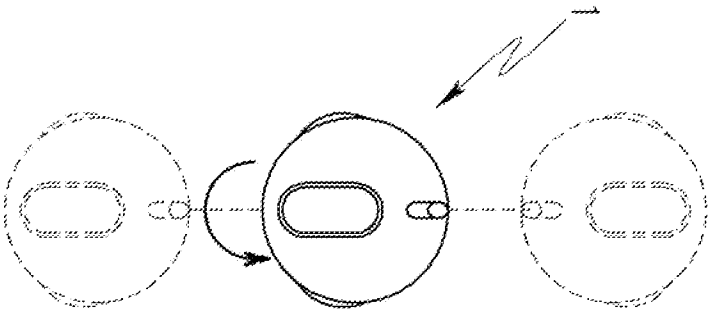

[FIG. 11E]
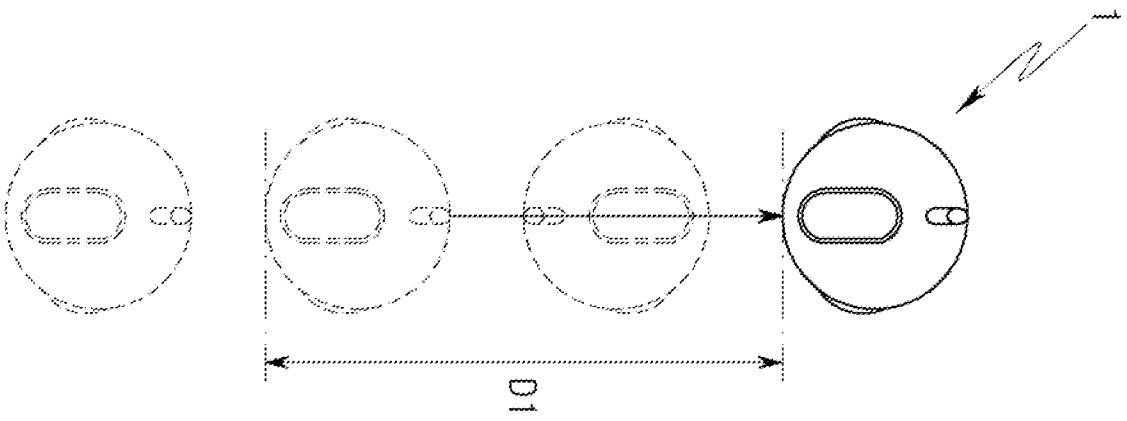

[FIG. 12A]
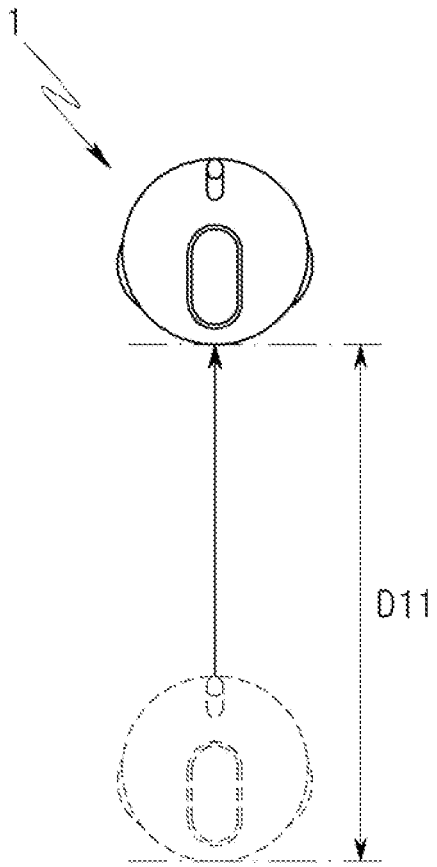

[FIG. 12B]
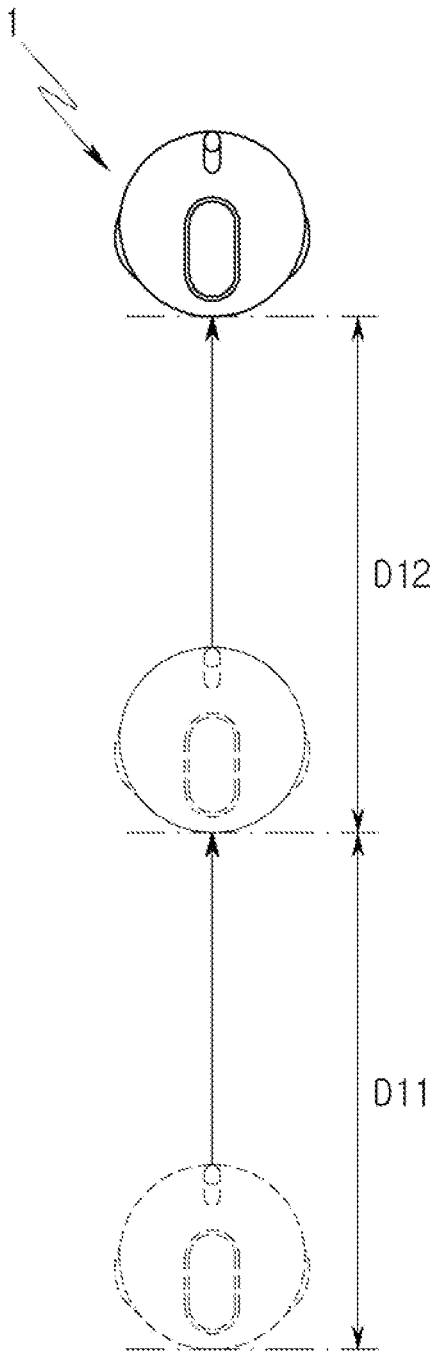

[FIG. 12C]
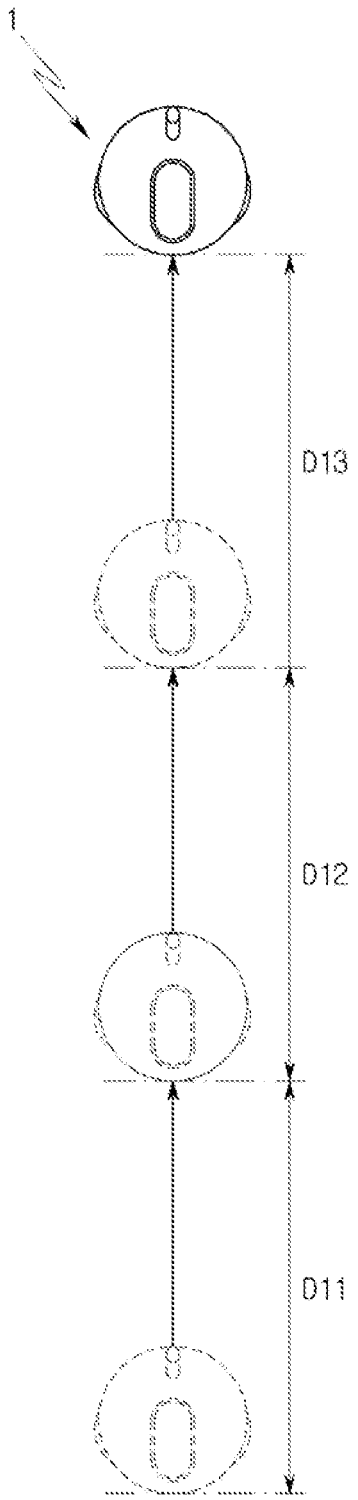

[FIG. 12D]
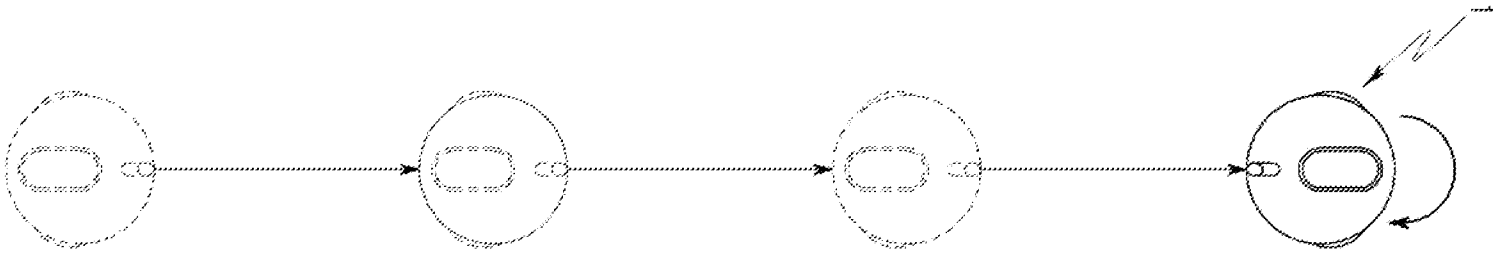

[FIG. 13A]
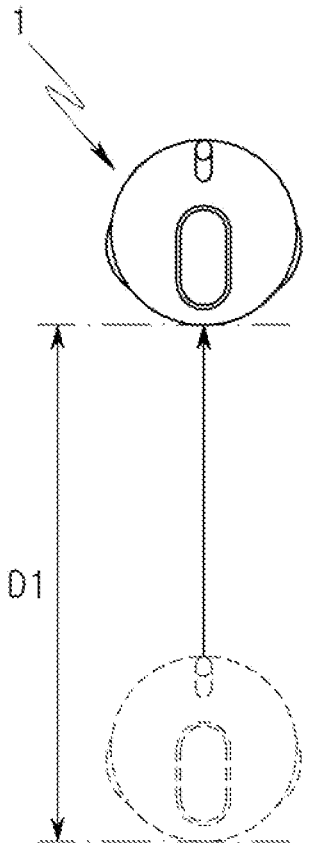

[FIG. 13B]
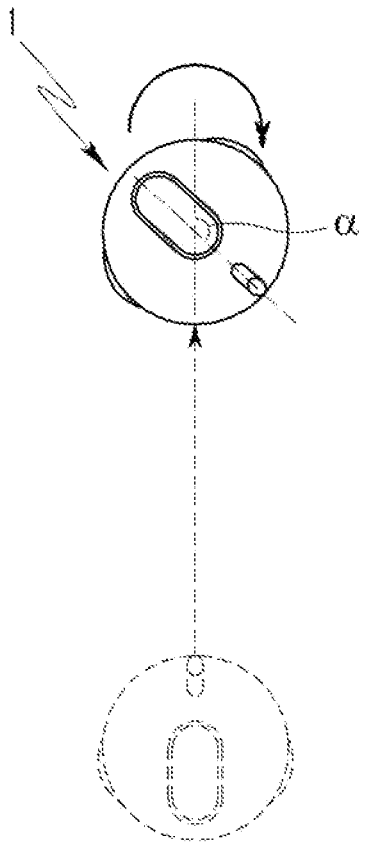

[FIG. 13C]
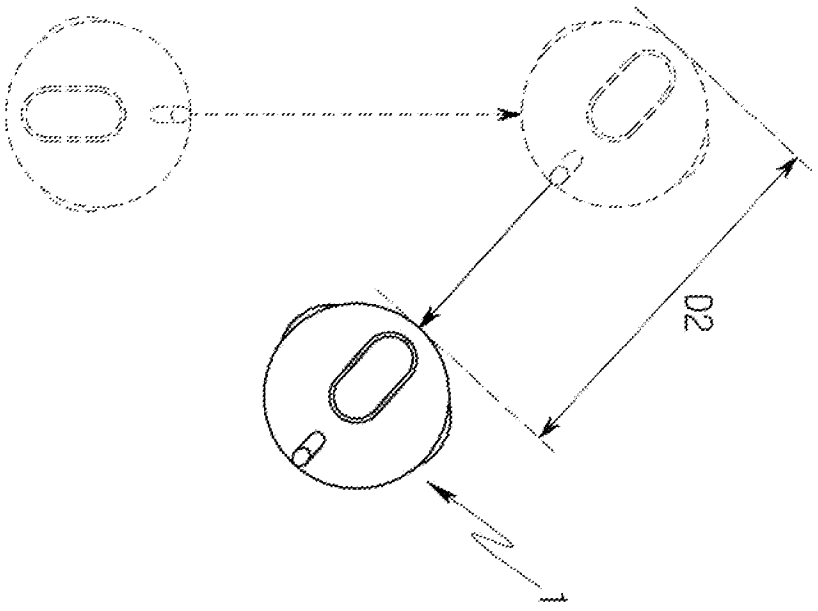

[FIG. 13D]
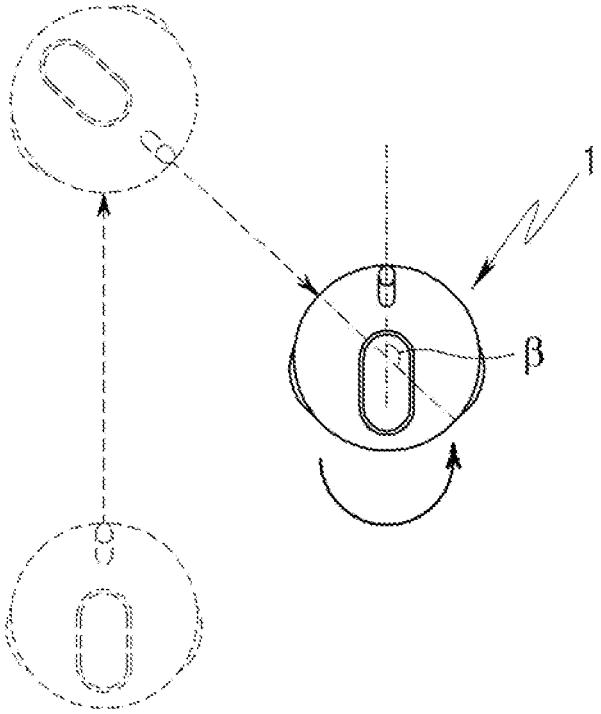

[FIG. 13E]
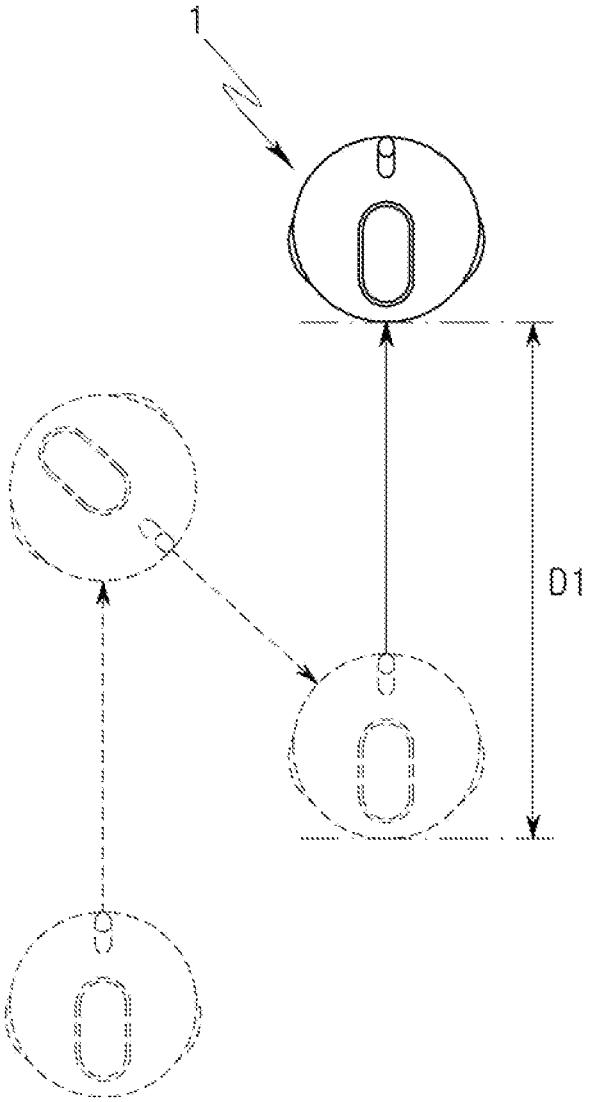

[FIG. 13F]
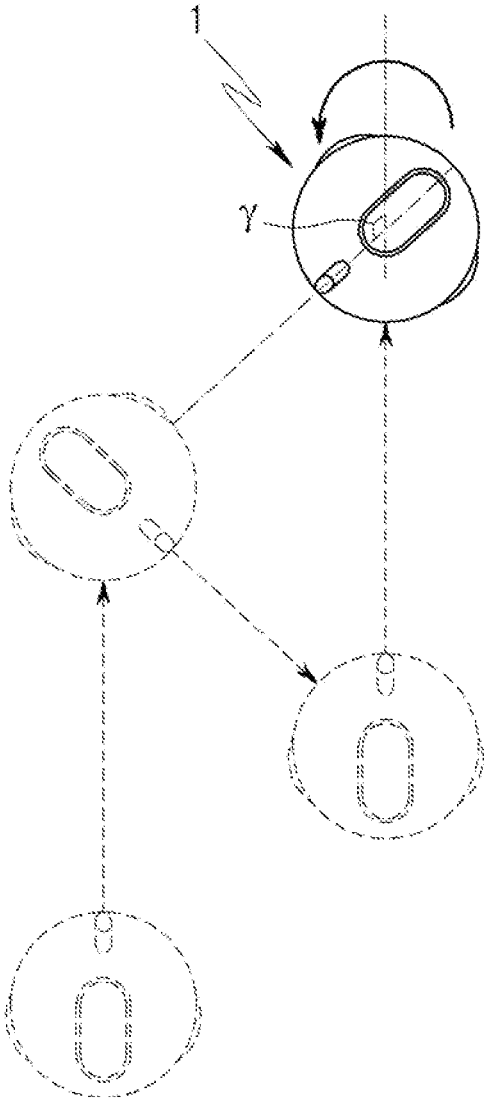

[FIG. 13G]
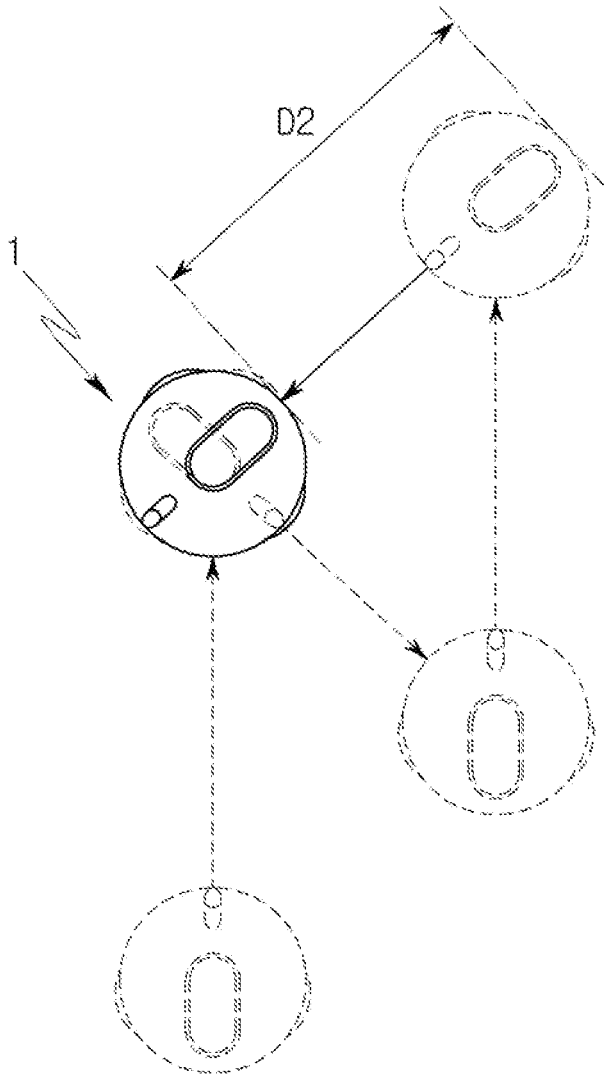

[FIG. 13H]
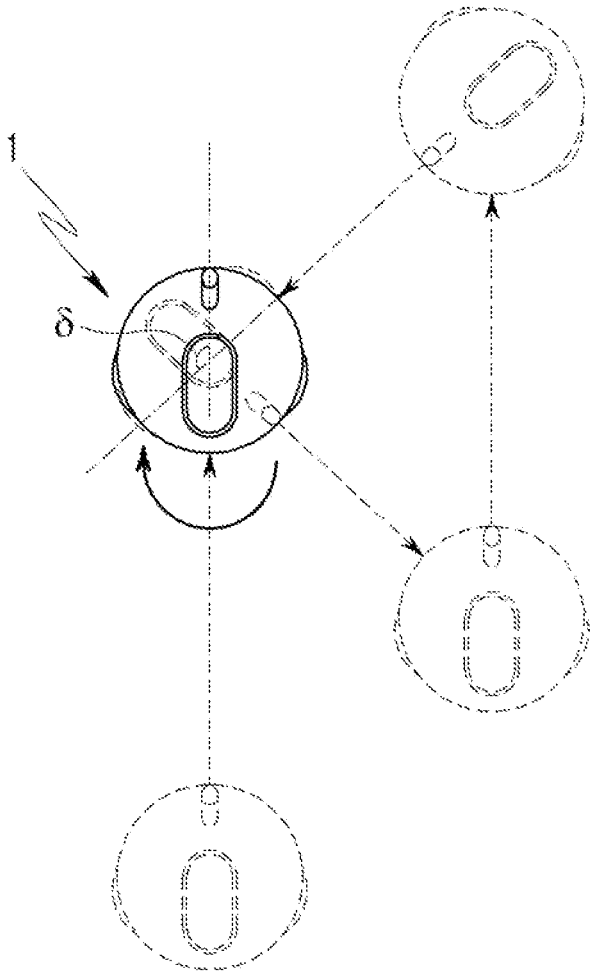

[FIG. 13I]
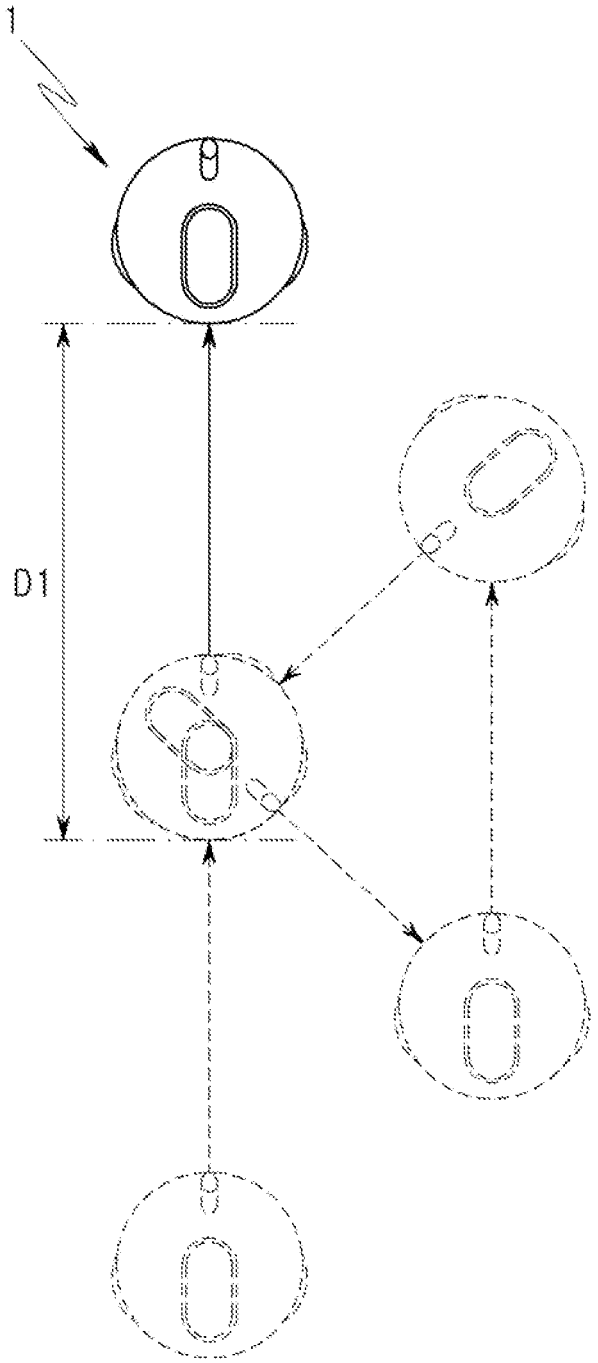

ROBOT CLEANER AND METHOD OF CONTROLLING ROBOT CLEANER

CROSS REFERENCE TO RELATED APPLICATIONS

This application is the National Phase of PCT International Application No. PCT/KR2021/005150, filed on Apr. 23, 2021, which claims priority under 35 U.S.C. 119(a) to Patent Application No. 10-2020-0050236, filed in the Republic of Korea on Apr. 24, 2020, all of which are hereby expressly incorporated by reference into the present application.

TECHNICAL FIELD

The present disclosure relates to a robot cleaner and a method of controlling the robot cleaner, and more particularly, to a robot cleaner capable of rotating a mop of the robot cleaner and moving and cleaning a floor using a frictional force between the mop and the floor, and a method of controlling the robot cleaner.

BACKGROUND ART

Recently, with the development of industrial technologies, a robot cleaner has been developed which performs a cleaning operation while autonomously moving in a zone required to be cleaned without a user's manipulation. Such a robot cleaner has a sensor capable of recognizing a space to be cleaned, and a mop capable of cleaning a floor surface, such that the robot cleaner may move while wiping, with the mop, the floor surface in the space recognized by the sensor.

Among the robot cleaners, there is a wet robot cleaner capable of wiping a floor surface with a mop containing moisture in order to effectively remove foreign substances strongly attached to the floor surface. The wet robot cleaner has a water container and is configured such that water accommodated in the water container is supplied to the mop and the mop containing moisture wipes the floor surface to effectively remove the foreign substances strongly attached to the floor surface.

The mop of the wet robot cleaner has a circular shape and is configured to wipe the floor surface while rotating in a state of being in contact with the floor surface. In addition, the robot cleaner is sometimes configured to move in a particular direction using a frictional force generated when a plurality of mops rotates in a state of being in contact with the floor surface.

Meanwhile, as the frictional force between the mop and the floor surface increases, the mop may strongly wipe the floor surface, such that the robot cleaner may effectively clean the floor surface.

Meanwhile, a general wet mop robot cleaner continuously moves forward until the robot cleaner recognizes an obstacle, and when the obstacle is detected, the robot cleaner may change a direction thereof and then move.

However, in a case in which the floor surface is severely contaminated and thus needs to be repeatedly and precisely cleaned by the mop, there is a limitation in clearly clean the floor surface.

Meanwhile, U.S. Pat. No. 9,801,518 B2 (Oct. 31, 2017) discloses a robot cleaner that cleans a floor surface while repeatedly moving on the floor surface.

The robot cleaner repeatedly moves on the floor surface in such a way that the robot cleaner moves forward and then moves rearward, without being rotated, by rotating wheels or mops reversely in a direction opposite to the direction for the forward movement.

However, in the case in which the robot cleaner repeatedly cleans the floor surface while moving rearward, as described above, the robot cleaner may easily collide with an obstacle and thus be easily damaged by the collision when performing the cleaning operation by moving rearward.

That is, because a sensor and a bumper are concentratedly disposed on a front surface of the robot cleaner, which corresponds to a main movement direction, in order to prevent a collision during the movement and absorb impact in the event of a collision, there is a high likelihood that the robot cleaner is damaged by a collision when performing the cleaning operation while moving rearward.

Meanwhile, Korean Patent No. KR 10-2014142 B1 (Aug. 20, 2019) discloses a robot cleaner that repeatedly cleans a predetermined region.

The robot cleaner may repeatedly clean a predetermined cleaning region while moving forward and rotating.

However, the robot cleaner performs the cleaning operation while repeatedly moving forward by a predetermined distance and then rotating by 180 degrees. In this case, a target point is disposed in a direction perpendicular to the forward direction of the robot cleaner. For this reason, a large amount of time is required to move the robot cleaner from a starting point to the target point.

DISCLOSURE

Technical Problem

The present disclosure has been made in an effort to solve the above-mentioned problems of the robot cleaner and the method of controlling the robot cleaner in the related art, and an object of the present disclosure is to provide a robot cleaner and a method of controlling the robot cleaner, which are configured to repeatedly clean a floor surface.

Another object of the present disclosure is to provide a robot cleaner and a method of controlling the robot cleaner, which are capable of precisely cleaning a severely contaminated floor surface.

Still another object of the present disclosure is to provide a robot cleaner capable of moving to a target point while repeatedly reciprocating on a floor surface, and a method of controlling the robot cleaner.

Yet another object of the present disclosure is to provide a robot cleaner and a method of controlling the robot cleaner, which may reduce the time required to move the robot cleaner and operation a cleaning operation.

Still yet another object of the present disclosure is to provide a robot cleaner and a method of controlling the robot cleaner, which may allow the robot cleaner to finally reach a target point even though the robot cleaner rotates multiple times.

Another further object of the present disclosure is to provide a robot cleaner and a method of controlling the robot cleaner, which may maintain a leftward/rightward direction movement range of the robot cleaner within a predetermined distance range.

Technical Solution

In order to achieve the above-mentioned objects, the present disclosure provides a robot cleaner configured to move from a starting point to a predetermined target point, the robot cleaner including: a main body having a bumper provided on a front surface thereof and having a space for accommodating a battery, a water container, and a motor therein; and a pair of rotary plates rotatably disposed on a bottom surface of the main body and having lower sides to which mops facing a floor surface are coupled.

In this case, the main body may move forward toward the target point, rotate, move forward again, and then rotate toward the target point.

The main body may move forward toward the target point by a predetermined first forward movement distance, rotate, and then move forward again by a predetermined second forward movement distance, and the first forward movement distance may be longer than the second forward movement distance.

The main body may move forward toward the target point while forming a curved trajectory having a predetermined curvature on the floor surface.

The main body may stop moving for a predetermined stop time while moving forward toward the target point.

The main body may move forward toward the target point and then rotate toward the starting point.

The main body may rotate by an angle of more than 90 degrees and 180 degrees or less based on a direction in which the main body moves forward.

The main body may move forward toward the target point, rotate by a predetermined first rotation angle, move forward again, and then rotate by a predetermined second rotation angle, and the first rotation angle and the second rotation angle may be equal in magnitude to each other and opposite in rotation direction to each other.

The main body may rotate by the second rotation angle, move forward, rotate by a predetermined third rotation angle, and then move forward, and the first rotation angle and the third rotation angle may be equal in magnitude to each other and opposite in rotation direction to each other.

The main body may rotate by the second rotation angle, move forward, rotate by a predetermined third rotation angle, and then move forward, and the second rotation angle and the third rotation angle may be equal in magnitude and rotation direction to each other.

The main body may move from the starting point to the target point while repeatedly moving forward and rotating, and regions in which the main body moves on the floor surface may at least partially overlap.

In order to achieve the above-mentioned objects, the present disclosure provides a method of controlling a robot cleaner including a pair of rotary plates having lower sides to which mops facing a floor surface are coupled, the robot cleaner being configured to move by rotating the pair of rotary plates, the method including: a first forward movement step of moving the robot cleaner forward from a starting point toward a predetermined target point; a first rotation step of rotating the robot cleaner; a second forward movement step of moving the robot cleaner forward after the first rotation step; and a second rotation step of rotating the robot cleaner after the second forward movement step.

The robot cleaner may move forward by a predetermined first forward movement distance in the first forward movement step, the robot cleaner may move forward by a predetermined second forward movement distance in the second forward movement step, and the first forward movement distance may be longer than the second forward movement distance.

When the robot cleaner moves forward toward the target point in the first forward movement step, the robot cleaner may move while forming a curved trajectory having a predetermined curvature on the floor surface.

In the first forward movement step, the robot cleaner may stop moving for a predetermined stop time while moving forward toward the target point.

The robot cleaner may rotate toward the starting point in the first rotation step.

In the first rotation step, the robot cleaner may rotate by an angle of more than 90 degrees and 180 degrees or less based on a direction in which a front surface of a main body of the robot cleaner is directed in the first forward movement step.

The robot cleaner may rotate by a predetermined first rotation angle in the first rotation step, the robot cleaner may rotate by a predetermined second rotation angle in the second rotation step, and the first rotation angle and the second rotation angle may be equal in magnitude to each other and opposite in rotation direction to each other.

The method of controlling a robot cleaner according to the embodiment of the present disclosure may further include: a third forward movement step of moving the robot cleaner forward after the second rotation step; and a third rotation step of rotating the robot cleaner after the third forward movement step.

In this case, the robot cleaner may rotate by a predetermined first rotation angle in the first rotation step, the robot cleaner may rotate by a predetermined third rotation angle in the third rotation step, and the first rotation angle and the third rotation angle may be equal in magnitude to each other and opposite in rotation direction to each other.

The robot cleaner may rotate by a predetermined second rotation angle in the second rotation step, the robot cleaner may rotate by a predetermined third rotation angle in the third rotation step, and the second rotation angle and the third rotation angle may be equal in magnitude and rotation direction to each other.

A region in which the robot cleaner moves on the floor surface in the first forward movement step may at least partially overlap a region in which the robot cleaner moves on the floor surface in the second forward movement step.

Advantageous Effect

According to the robot cleaner and the method of controlling the robot cleaner according to the present disclosure described above, the robot cleaner may repeatedly clean the floor surface only by moving forward and rotating.

Therefore, the severely contaminated floor surface may be precisely cleaned.

In addition, the main body moves forward toward the target point, rotates, and then moves forward again, and the distance during the forward movement toward the target point is longer than the forward movement distance. As a result, the main body may repeatedly clean the floor surface while gradually moving toward the target point.

Therefore, because the forward direction coincides with the direction of the final target point, it is possible to reduce the time required to move the robot cleaner and perform the cleaning operation.

In addition, the main body moves forward toward the target point, rotates by the predetermined first rotation angle, moves forward again, and then rotates by the predetermined second rotation angle. The first rotation angle and the second rotation angle are equal in magnitude to each other but opposite in rotation direction to each other. As a result, the robot cleaner may finally reach the target point even though the robot cleaner rotates multiple times.

In addition, the main body may rotate by the second rotation angle, move forward, rotate by the predetermined third rotation angle, and then move forward. The third rotation angle may be equal in magnitude and rotation direction to the second rotation angle. The third rotation angle may be equal in magnitude to the first rotation angle but opposite in rotation direction to the first rotation angle. Therefore, a leftward/rightward direction movement range of the robot cleaner may be maintained in a predetermined distance range.

In addition, the main body moves from the starting point to the target point while repeatedly moving forward and rotating, and the regions in which the pair of rotary plates or the pair of mops comes into contact with the floor surface at least partially overlap. As a result, the robot cleaner repeatedly moves in the cleaning region, thereby improving the cleaning effect.

DESCRIPTION OF DRAWINGS

FIG. 1 is a perspective view illustrating a robot cleaner according to an embodiment of the present disclosure.

FIG. 2 is a view illustrating some components separated from the robot cleaner illustrated in FIG. 1.

FIG. 3 is a rear view illustrating the robot cleaner illustrated in FIG. 1.

FIG. 4 is a bottom plan view illustrating the robot cleaner according to the embodiment of the present disclosure.

FIG. 5 is an exploded perspective view illustrating the robot cleaner.

FIG. 6 is a cross-sectional view schematically illustrating the robot cleaner and components of the robot cleaner according to the embodiment of the present disclosure.

FIG. 7 is a view for explaining a movement direction of the robot cleaner according to the embodiment of the present disclosure.

FIG. 8 is a schematic view illustrating the robot cleaner according to the embodiment of the present disclosure when viewed from above.

FIG. 9 is a block diagram of the robot cleaner according to the embodiment of the present disclosure.

FIG. 10 is a flowchart illustrating a method of controlling the robot cleaner according to the embodiment of the present disclosure.

FIGS. 11A-11E are views for schematically explaining a route along which the robot cleaner moves in accordance with the method of controlling the robot cleaner according to the embodiment of the present disclosure.

FIGS. 12A-12D are views for explaining a process of stopping the robot cleaner during the forward movement of the robot cleaner in accordance with the method of controlling the robot cleaner according to the embodiment of the present disclosure.

FIGS. 13A-13I are views for schematically explaining a movement route in a case in which a rotation angle of the robot cleaner is larger than 90 degrees and smaller than 180 degrees in accordance with the method of controlling the robot cleaner according to the embodiment of the present disclosure.

MODE FOR INVENTION

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

The terms used herein is used for the purpose of describing particular embodiments only and is not intended to limit the present disclosure. Singular expressions may include plural expressions unless clearly described as different meanings in the context. Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

FIGS. 1 to 6 are structural views for explaining a structure of a robot cleaner according to an embodiment of the present disclosure, and FIGS. 7 and 8 are views for explaining movement directions of the robot cleaner according to the embodiment of the present disclosure.

More specifically, FIG. 1 is a perspective view illustrating a robot cleaner 1, FIG. 2 is a view illustrating some components separated from the robot cleaner 1, FIG. 3 is a rear view of the robot cleaner 1, FIG. 4 is a bottom plan view of the robot cleaner 1, FIG. is an exploded perspective view of the robot cleaner 1, and FIG. 6 is a cross-sectional view illustrating an interior of the robot cleaner 1.

A structure of the robot cleaner 1 according to the present disclosure will be described below with reference to FIGS. 1 to 8.

The robot cleaner 1 is configured to be placed on a floor and clean the floor using mops while moving on a floor surface B. Therefore, hereinafter, a vertical direction is defined based on a state in which the robot cleaner 1 is placed on the floor.

Further, a side at which a first lower sensor 123 to be described below is defined as a front side based on a first rotary plate 10 and a second rotary plate 20.

Among the portions described in the present disclosure, a 'lowermost portion' may be a portion positioned at a lowest position or a portion closest to the floor when the robot cleaner 1 is placed on the floor and used.

The robot cleaner 1 may include a main body 50, rotary plates 10 and 20, and mops 30 and 40. In this case, the rotary plates 10 and 20 may be provided in a pair and include a first rotary plate 10 and a second rotary plate 20, and the mops 30 and 40 may include a first mop 30 and a second mop 40.

The main body 50 may define an entire external shape of the robot cleaner 1 or may be provided in the form of a frame. Components constituting the robot cleaner 1 may be coupled to the main body 50, and some of the components constituting the robot cleaner 1 may be accommodated in the main body 50. The main body 50 may be divided into a lower main body 50*a* and an upper main body 50*b*. The components of the robot cleaner 1 including a battery 135, a water container 141, and motors 56 and 57 are provided in a space defined by coupling the lower main body 50*a* and the upper main body 50*b* (see FIG. 5).

The first rotary plate 10 may be rotatably disposed on a bottom surface of the main body 50, and the first mop 30 may be coupled to a lower side of the first rotary plate 10.

The first rotary plate 10 has a predetermined area and is provided in the form of a flat plate, a flat frame, or the like. The first rotary plate 10 is laid approximately horizontally, such that a width (or a diameter) in the horizontal direction is sufficiently larger than a height in the vertical direction thereof. The first rotary plate 10 coupled to the main body 50 may be parallel to the floor surface B or inclined with respect to the floor surface B. The first rotary plate 10 may be provided in the form of a circular plate, a bottom surface of the first rotary plate 10 may be approximately circular, and the first rotary plate 10 may entirely have a rotationally symmetrical shape.

The second rotary plate 20 may be rotatably disposed on the bottom surface of the main body 50, and the second mop 40 may be coupled to a lower side of the second rotary plate 20.

The second rotary plate 20 has a predetermined area and is provided in the form of a flat plate, a flat frame, or the like. The second rotary plate 20 is laid approximately horizontally, such that a width (or a diameter) in the horizontal direction thereof is sufficiently larger than a height in the vertical direction thereof. The second rotary plate coupled to the main body 50 may be parallel to the floor surface B or inclined with respect to the floor surface B. The second rotary plate 20 may be provided in the form of a circular plate shape, a bottom surface of the second rotary plate 20 may be approximately circular, and the second rotary plate 20 may entirely have a rotationally symmetrical shape.

In the robot cleaner 1, the second rotary plate 20 may be identical to the first rotary plate 10 or the second rotary plate 20 and the first rotary plate 10 may be provided symmetrically. When the first rotary plate 10 is positioned at a left side of the robot cleaner 1, the second rotary plate 20 may be positioned at a right side of the robot cleaner 1. In this case, the first rotary plate 10 and the second rotary plate 20 may be vertically symmetric.

The first mop 30 may be coupled to the lower side of the first rotary plate 10 so as to face the floor surface B.

A bottom surface of the first mop 30, which is directed toward the floor, has a predetermined area, and the first mop 30 has a flat shape. The first mop 30 is configured such that a width (or a diameter) in the horizontal direction thereof is sufficiently larger than a height in the vertical direction thereof. When the first mop 30 is coupled to the main body 50, the bottom surface of the first mop 30 may be parallel to the floor surface B or inclined with respect to the floor surface B.

The bottom surface of the first mop 30 may be approximately circular, and the first mop 30 may entirely have a rotationally symmetrical shape. In addition, the first mop 30 may be attached to or detached from the bottom surface of the first rotary plate 10. The first mop 30 may be coupled to the first rotary plate 10 and rotate together with the first rotary plate 10.

The second mop 40 may be coupled to the lower side of the second rotary plate so as to face the floor surface B.

A bottom surface of the second mop 40, which is directed toward the floor, has a predetermined area, and the second mop 40 has a flat shape. The second mop 40 is configured such that a width (or a diameter) in the horizontal direction thereof is sufficiently larger than a height in the vertical direction thereof. When the second mop is coupled to the main body 50, the bottom surface of the second mop 40 may be parallel to the floor surface B or inclined with respect to the floor surface B.

The bottom surface of the second mop 40 may be approximately circular, and the second mop 40 may entirely have a rotationally symmetrical shape. In addition, the second mop 40 may be attached to or detached from the bottom surface of the second rotary plate 20. The second mop 40 may be coupled to the second rotary plate 20 and rotate together with the second rotary plate 20.

When the first rotary plate 10 and the second rotary plate 20 rotate in opposite directions at the same velocity, the robot cleaner 1 may move forward or rearward in a straight direction. For example, when the first rotary plate 10 rotates counterclockwise and the second rotary plate 20 rotates clockwise when viewed from above, the robot cleaner 1 may move forward.

When only any one of the first rotary plate 10 and the second rotary plate 20 rotates, the robot cleaner 1 may change the direction thereof and turn.

When a rotational velocity of the first rotary plate 10 and a rotational velocity of the second rotary plate 20 are different from each other or the first rotary plate 10 and the second rotary plate 20 rotate in the same direction, the robot cleaner 1 may move while changing the direction thereof and move in a curved direction.

The robot cleaner 1 may further include the first lower sensor 123.

The first lower sensor 123 is provided at the lower side of the main body 50 and configured to detect a relative distance to the floor B. The first lower sensor 123 may be variously configured as long as the first lower sensor 123 may detect the relative distance between the floor surface B and the point at which the first lower sensor 123 is provided.

When the relative distance to the floor surface B (a distance in the vertical direction from the floor surface or a distance in the direction inclined with respect to the floor surface), which is detected by the first lower sensor 123, exceeds a predetermined value or exceeds a predetermined range, this may be a case in which the floor surface is rapidly lowered. Therefore, the first lower sensor 123 may detect a cliff.

The first lower sensor 123 may be an optical sensor and include a light-emitting portion for emitting light, and a light-receiving portion for receiving reflected light. The first lower sensor 123 may be an infrared sensor.

The first lower sensor 123 may be referred to as a cliff sensor.

The robot cleaner 1 may further include a second lower sensor 124 and a third lower sensor 125.

When an imaginary line, which connects a center of the first rotary plate 10 and a center of the second rotary plate 20 in the horizontal direction (the direction parallel to the floor surface B), is a connection line L1, the second lower sensor 124 and the third lower sensor 125 may be provided at the lower side of the main body 50 and disposed at the same side as the first lower sensor 123 based on the connection line L1. The second lower sensor 124 and the third lower sensor 125 may be configured to detect the relative distance to the floor B (see FIG. 4).

The third lower sensor 125 may be provided at a side opposite to the second lower sensor 124 based on the first lower sensor 123.

Each of the second lower sensor 124 and the third lower sensor 125 may be variously configured as long as each of the second lower sensor 124 and the third lower sensor 125 may detect the relative distance to the floor surface B. Each of the second lower sensor 124 and the third lower sensor 125 may be identical to the first lower sensor 123 except for the positions at which the sensors are provided.

The robot cleaner 1 may further include the first motor 56, the second motor 57, the battery 135, the water container 141, and a water supply tube 142.

The first motor 56 may be coupled to the main body 50 and configured to rotate the first rotary plate 10. Specifically, the first motor 56 may be an electric motor coupled to the main body 50, and one or more gears may be connected to the first motor 56 to transmit a rotational force to the first rotary plate 10.

The second motor 57 may be coupled to the main body 50 and configured to rotate the second rotary plate 20. Specifically, the second motor 57 may be an electric motor coupled to the main body 50, and one or more gears may be connected to the second motor 57 to transmit a rotational force to the second rotary plate 20.

As described above, in the robot cleaner 1, the first rotary plate 10 and the first mop 30 may be rotated by the operation of the first motor 56, and the second rotary plate and the second mop 40 may be rotated by the operation of the second motor 57.

The second motor 57 and the first motor 56 may be symmetric (vertically symmetric).

The battery 135 may be coupled to the main body 50 and configured to supply power the other components constituting the robot cleaner 1. The battery 135 may supply power to the first motor 56 and the second motor 57.

The battery 135 may be charged with external power. To this end, a charging terminal for charging the battery 135 may be provided at one side of the main body 50 or provided on the battery 135.

In the robot cleaner 1, the battery 135 may be coupled to the main body 50.

The water container 141 is provided in the form of a container having an internal space that stores therein a liquid such as water. The water container 141 may be fixedly coupled to the main body 50 or detachably coupled to the main body 50.

In the robot cleaner 1, the water supply tube 142 is provided in the form of a tube or a pipe and connected to the water container 141 so that the liquid in the water container 141 may flow through the inside of the water supply tube 142. An end of the water supply tube 142, which is opposite to the side at which the water supply tube 142 is connected to the water container 141, is provided above the first rotary plate 10 and the second rotary plate 20, such that the liquid in the water container 141 may be supplied to the first mop 30 and the second mop 40.

In the robot cleaner 1, the water supply tube 142 may be provided in a shape having two tube portions diverged from a single tube portion. In this case, an end of one diverged tube portion may be positioned above the first rotary plate 10, and an end of the other diverged tube portion may be positioned above the second rotary plate 20.

The robot cleaner 1 may have a separate water pump 143 to move the liquid through the water supply tube 142.

The robot cleaner 1 may further include a bumper 58, a first sensor 121, and a second sensor 122.

The bumper 58 is coupled along a rim of the main body 50 and configured to move relative to the main body 50. For example, the bumper 58 may be coupled to the main body 50 so as to be reciprocally movable in a direction toward the center of the main body 50.

The bumper 58 may be coupled along a part of the rim of the main body 50 or coupled along the entire rim of the main body 50.

The first sensor 121 may be coupled to the main body 50 and configured to detect a motion (relative movement) of the bumper 58 relative to the main body 50. The first sensor 121 may be a microswitch, a photo-interrupter, a tact switch, or the like.

The second sensor 122 may be coupled to the main body 50 and configured to detect the relative distance to an obstacle. The second sensor 122 may be a distance sensor.

Meanwhile, the robot cleaner 1 according to the embodiment of the present disclosure may further include a displacement sensor 126.

The displacement sensor 126 may be disposed on the bottom surface (rear surface) of the main body 50 and measure a distance by which the robot cleaner moves along the floor surface.

For example, an optical flow sensor (OFS) for acquiring image information on the floor surface using light may be used as the displacement sensor 126. In this case, the optical flow sensor (OFS) includes an image sensor configured to acquire image information on the floor surface by capturing an image of the floor surface, and one or more light sources configured to adjust the amount of light.

An operation of the displacement sensor 126 will be described as an example of the optical flow sensor. The optical flow sensor is provided on the bottom surface (rear surface) of the robot cleaner 1 and captures an image of a lower portion, that is, the floor surface while the robot cleaner 1 moves. The optical flow sensor converts a lower image inputted from the image sensor and creates a predetermined lower image information.

With this configuration, the displacement sensor 126 may detect a position of the robot cleaner 1 relative to a predetermined point regardless of slippage. That is, the optical flow sensor may be used to observe the lower portion of the robot cleaner 1, such that it is possible to correct a position caused by slippage.

Meanwhile, the robot cleaner 1 according to the embodiment of the present disclosure may further include an angle sensor 127.

The angle sensor 127 may be disposed in the main body 50 and measure a movement angle of the main body 50.

For example, a gyro sensor for measuring a rotational velocity of the main body 50 may be used as the angle sensor 127. The gyro sensor may detect the direction of the robot cleaner 1 using the rotational velocity.

With this configuration, based on a predetermined imaginary line, the angle sensor 127 may detect a direction in which the robot cleaner 1 moves and an angle at which the robot cleaner 1 moves.

Meanwhile, the present disclosure may further include the imaginary connection line L1 that connects rotation axes of the pair of rotary plates 10 and 20. Specifically, the connection line L1 may mean an imaginary line that connects the rotation axis of the first rotary plate 10 and the rotation axis of the second rotary plate 20.

The connection line L1 may be a criterion based on which the front and rear sides of the robot cleaner 1 are defined. For example, a side at which the second sensor 122 is disposed based on the connection line L1 may be referred to as the front side of the robot cleaner 1, and a side at which the water container 141 is disposed based on the connection line L1 may be referred to as the rear side of the robot cleaner 1.

Therefore, based on the connection line L1, the first lower sensor 123, the second lower sensor 124, and the third lower sensor 125 may be disposed at a front lower side of the main body 50, the first sensor 121 may be disposed inside a front outer circumferential surface of the main body 50, and the second sensor 122 may be disposed at a front upper side of the main body 50. In addition, based on the connection line L1, the battery 135 may be inserted and coupled into a front side of the main body 50 in a direction perpendicular to the floor surface B. Further, based on the connection line L1, the displacement sensor 126 may be disposed at a rear side of the main body 50.

Therefore, based on the connection line L1, a surface of the main body 50 on which the second sensor 122 and the bumper 58 are positioned may be referred to as a front surface of the main body 50, and a surface of the main body 50, which is opposite to the front surface, may be referred to as a rear surface of the main body 50.

Therefore, a forward direction of the robot cleaner 1 may mean a direction in which the second sensor 122 is directed, and the configuration in which the robot cleaner 1 moves forward may mean that the robot cleaner 1 moves in the forward direction. In addition, a rearward direction of the robot cleaner 1 may mean a direction opposite to the forward direction, and the configuration in which the robot cleaner 1 moves rearward may mean that the robot cleaner 1 moves in a direction opposite to the forward direction.

Meanwhile, the present disclosure may further include an imaginary movement direction line H that extends in parallel with the floor surface B and perpendicularly intersects the connection line L1 at an intermediate point C of the connection line L1. Specifically, the movement direction line H may include a forward movement direction line Hf extending in parallel with the floor surface B toward the side at which the battery 135 is disposed based on the connection line L1, and a rearward movement direction line Hb extending in parallel with the floor surface B toward the side at which the water container 141 is disposed based on the connection line L1.

In this case, the battery 135, the first lower sensor 123, and the second sensor 122 may be disposed on the forward movement direction line Hf, and the displacement sensor 126 and the water container 141 may be disposed on the rearward movement direction line Hb. Further, based on the movement direction line H, the first rotary plate 10 and the second rotary plate 20 may be disposed symmetrically (linearly symmetrically).

Meanwhile, FIG. 9 is a block diagram of the robot cleaner according to the present disclosure illustrated in FIG. 1.

Referring to FIG. 9, the robot cleaner 1 may include a control part 110, a sensor part 120, a power source part 130, a water supply part 140, a drive part 150, a communication part 160, a display part 170, and a memory 180. The constituent elements illustrated in the block diagram of FIG. 9 are not essential to implement the robot cleaner 1. The robot cleaner 1 described in the present specification may have the constituent elements larger or smaller in number than the constituent elements listed above.

First, the control part 110 may be disposed in the main body 50 and connected to a control device (not illustrated) in a wireless communication manner through the communication part 160 to be described below. In this case, the control part 110 may transmit various data in relation to the robot cleaner 1 to the connected control device (not illustrated). Further, the control part 110 may receive inputted data from the control device and store the data. In this case, the data inputted from the control device may be a control signal for controlling at least one function of the robot cleaner 1.

In other words, the robot cleaner 1 may receive the control signal made based on a user's input from the control device and operate based on the received control signal.

In addition, the control part 110 may control an overall operation of the robot cleaner. The control part 110 controls the robot cleaner 1 so that the robot cleaner 1 performs the cleaning operation while autonomously moving on a cleaning target surface based on set information stored in the memory 180 to be described below.

Meanwhile, in the present disclosure, a process of controlling a straight movement by the control part 110 will be described below.

The sensor part 120 may include one or more of the first lower sensor 123, the second lower sensor 124, the third lower sensor 125, the first sensor 121, and the second sensor 122 of the robot cleaner 1 which are described above.

In other words, the sensor part 120 may include a plurality of different sensors capable of detecting the environment at the periphery of the robot cleaner 1. Information on the environment at the periphery of the robot cleaner 1 detected by the sensor part 120 may be transmitted to the control device by the control part 110. In this case, the information on the peripheral environment may be whether an obstacle is present, whether a cliff is detected, whether a collision is detected, or the like, for example.

The control part 110 may control the operations of the first motor 56 and/or the second motor 57 based on the information detected by the first sensor 121. For example, when the bumper 58 comes into contact with an obstacle while the robot cleaner 1 moves, the first sensor 121 may recognize a position at which the bumper 58 comes into contact with the obstacle, and the control part 110 may control the operations of the first motor 56 and/or the second motor 57 so that the robot cleaner 1 departs from the contact position.

In addition, when a distance between the robot cleaner 1 and the obstacle is a predetermined value or less based on the information detected by the second sensor 122, the control part 110 may control the operations of the first motor 56 and/or the second motor 57 so that the movement direction of the robot cleaner 1 is changed or the robot cleaner 1 moves away from the obstacle.

In addition, based on a distance detected by the first lower sensor 123, the second lower sensor 124, or the third lower sensor 125, the control part 110 may control the operations of the first motor 56 and/or the second motor 57 so that the robot cleaner 1 is stopped or the movement direction is changed.

In addition, based on a distance detected by the displacement sensor 126, the control part 110 may control the operations of the first motor 56 and/or the second motor 57 so that the movement direction of the robot cleaner 1 is changed. For example, when the robot cleaner 1 slips and deviates from the inputted movement route or movement pattern, the displacement sensor 126 may measure a distance by which the robot cleaner 1 deviates from the inputted movement route or movement pattern, and the control part 110 may control the operations of the first motor 56 and/or the second motor 57 to compensate for the deviation.

In addition, based on an angle detected by the angle sensor 127, the control part 110 may control the operations of the first motor 56 and/or the second motor 57 so that the movement direction of the robot cleaner 1 is changed. For example, when the robot cleaner 1 slips and a direction toward the robot cleaner 1 deviates from an inputted movement direction, the angle sensor 127 may measure an angle by which the direction toward the robot cleaner 1 deviates from the inputted movement direction, and the control part 110 may control the operations of the first motor 56 and/or the second motor 57 to compensate for the deviation.

Meanwhile, under control of the control part 110, the power source part 130 receives power from an external power source or an internal power source and supplies the power required to operate the respective constituent elements. The power source part 130 may include the above-mentioned battery 135 of the robot cleaner 1.

The water supply part 140 may include the water container 141, the water supply tube 142, and the water pump 143 of the robot cleaner 1 which are described above. The water supply part 140 may be configured to adjust a feed rate of the liquid (water) to be supplied to the first mop 30 and the second mop 40 during the cleaning operation of the robot cleaner 1 based on the control signal of the control part 110. The control part 110 may control an operating time of a motor that operates the water pump 143 to adjust the feed rate.

The drive part 150 may include the first motor 56 and the second motor 57 of the robot cleaner 1 which are described above. The drive part 150 may be configured to allow the robot cleaner 1 to rotate or rectilinearly move based on the control signal of the control part 110.

Meanwhile, the communication part 160 may be disposed in the main body 50 and may include at least one module that enables wireless communication between the robot cleaner 1 and a wireless communication system, between the robot cleaner 1 and a preset peripheral device, or between the robot cleaner 1 and a preset external server.

For example, the module may include at least one of an IR (infrared) module for infrared communication, an ultrasonic module for ultrasonic communication, and a short distance communication module such as a WiFi module or a Bluetooth module. Alternatively, the module may include a wireless Internet module to transmit and receive data to/from the preset devices through various wireless technologies such as WLAN (wireless LAN) or Wi-Fi (wireless fidelity).

Meanwhile, the display part 170 displays information to be provided to the user. For example, the display part 170 may include a display for displaying a screen. In this case, the display may be exposed from an upper surface of the main body 50.

In addition, the display part 170 may include a speaker configured to output sound. For example, the speaker may be embedded in the main body 50. In this case, the main body 50 may have a hole that is formed to correspond to a position of the speaker allows sound to pass therethrough. A source of the sound outputted by the speaker may be sound data pre-stored in the robot cleaner 1. For example, the pre-stored sound data may be related to audio guidance corresponding to the respective functions of the robot cleaner 1 or alarm sound indicating errors.

In addition, the display part 170 may include any one of a light-emitting diode (LED), a liquid crystal display (LCD), a plasma display panel, and an organic light-emitting diode (OLED).

The memory 180 may include various data for driving and operating the robot cleaner. The memory 180 may include application programs and various related data for allowing the robot cleaner 1 to autonomously move. In addition, the memory 180 may store respective data detected by the sensor part 120 and include set information about various set values (e.g., reserved cleaning time, cleaning modes, feed rates, LED brightness, volume sizes of notification sound, and the like) selected or inputted by the user.

Meanwhile, the memory 180 may include information about a cleaning target surface given to the current robot cleaner 1. For example, the information about the cleaning target surface may be map information autonomously mapped by the robot cleaner 1. Further, the map information, that is, the map may include various information set by the user in respect to the respective regions constituting the cleaning target surface.

Meanwhile, FIG. 10 is a flowchart illustrating a method of controlling the robot cleaner according to the embodiment of the present disclosure, and FIGS. 11 to 13 are views for schematically explaining routes along which the robot cleaner 1 moves in accordance with the method of controlling the robot cleaner according to the embodiment of the present disclosure.

The method of controlling the robot cleaner according to the embodiment of the present disclosure will be described below with reference to FIGS. 1 to 13.

The method of controlling the robot cleaner according to the embodiment of the present disclosure includes a movement preparation step S5, a first forward movement step S10, a first rotation step S20, a second forward movement step S30, and a second rotation step S40.

In the movement preparation step S5, the control part 110 may set a starting point P1 and a target point P2 and set a movement route.

For example, in the movement preparation step S5, the user may input a coordinate of a particular position in the cleaning region or a specific structure through a terminal (not illustrated) or the like. In this case, the user may input, through the terminal or the like, the starting point P1 from which the robot cleaner 1 starts to move, and the target point P2 at which the movement is ended.

Alternately, in the movement preparation step S5, the control part 110 may detect a degree of contamination of the floor surface B and set the starting point P1 and the target point P2 so that the robot cleaner 1 moves and passes through a specific location with a high degree of contamination.

In a case in which the robot cleaner 1 is not positioned at the starting point P1, the control part 110 may control and move the robot cleaner 1 to the starting point P1.

Meanwhile, when the robot cleaner 1 is positioned at the starting point P1, the control part 110 may perform control so that the movement direction line H of the robot cleaner 1 is directed toward the target point P2. That is, the control part 110 may calculate an angle difference between the movement direction line H and the target point P2 and operate the first motor 56 and/or the second motor 57 to rotate the robot cleaner 1 by the angle difference so that the movement direction line H and the target point P2 are coincident with each other.

In this case, the control part 110 may operate the first motor 56 and the second motor 57 in the same rotation direction and at the same rotational velocity to rotate the robot cleaner 1 in place. That is, the first rotary plate 10 and the second rotary plate 20 may rotate the robot cleaner 1 in place while rotating in the equal rotation direction and at the equal rotational velocity.

Meanwhile, in the embodiment, the control part 110 may perform control for compensating for slippage when the robot cleaner 1 slips when rotating in place.

Further, when a movement line LD connecting the starting point P1 and the target point P2 coincides with the movement direction line H of the robot cleaner 1, the control part 110 may start the forward movement.

In the first forward movement step S10, the control part 110 may move the robot cleaner 1 forward from the starting point P1 to the predetermined target point P2 (see FIGS. 11A and 13A).

When the robot cleaner starts to move forward, the control part 110 may rotate the first motor 56 and the second motor 57 in opposite directions. For example, the robot cleaner 1 may move forward when the first rotary plate 10 rotates counterclockwise and the second rotary plate 20 rotates clockwise when viewed from above the ground surface.

In the first forward movement step S10, the robot cleaner 1 may move forward by a predetermined first forward movement distance D1.

For example, in the first forward movement step S10, the robot cleaner 1 may rectilinearly move forward by the first forward movement distance D1. In this case, the first rotary plate 10 and the second rotary plate 20 may be rotated in opposite directions, and a rotational velocity ω1 of the first rotary plate 10 and a rotational velocity ω2 of the second rotary plate 20 may be equal to each other (ω1=ω2). That is, in the first forward movement step S10, the control part 110 may operate the first motor 56 and the second motor 57 with the same output. Further, in the first forward movement step S10, a relative movement velocity v1 of the first mop 30 to the floor surface B may be equal to a relative movement velocity v2 of the second mop 40 to the floor surface B (v1=v2).

As another example, in the first forward movement step S10, the robot cleaner 1 may move forward while forming a curved trajectory having a predetermined curvature on the floor surface. That is, in the first forward movement step S10, the robot cleaner 1 may move forward toward the target point P2 while forming a curved trajectory having a predetermined curvature on the floor surface. That is, the first rotary plate 10 and the second rotary plate 20 may rotate in opposite directions in such a way that the rotational velocities of the first rotary plate 10 and the second rotary plate 20 are different from each other. In this case, a difference (ω1−ω2=□ω) in rotational velocities between the first rotary plate 10 and the second rotary plate 20 may be constant.

Meanwhile, in the first forward movement step S10, the robot cleaner 1 may stop moving at least once while the robot cleaner 1 moves forward toward the target point P2.

For example, in the first forward movement step S10, the robot cleaner 1 may stop moving for a predetermined stop time ts1. That is, in the first forward movement step S10, the first rotary plate 10 and the second rotary plate 20 stop rotating for the stop time ts1 (ω1=ω2=0) and then continue to rotate.

As another example, in the first forward movement step S10, the robot cleaner 1 may stop moving twice for the predetermined stop time ts1. That is, in the first forward movement step S10, the robot cleaner 1 may stop moving for the predetermined stop time ts1 while moving forward, move forward again, stop moving for the predetermined stop time ts1, and then move forward again. In this case, the robot cleaner 1 may move by a predetermined distance D11, stop moving, move forward again by a predetermined distance D12, stop moving, move forward again by a predetermined distance D13 (see FIGS. 12A to 12D). In this case, the distances by which the robot cleaner 1 moves may be equal to one another (D11=D12=D13) or different one another in another embodiment. However, a sum of the distances by which the robot cleaner 1 moves forward is the first forward movement distance (D1=D11+D12+D13).

In the first rotation step S20, the control part 110 may rotate the robot cleaner 1. That is, the robot cleaner 1 may move forward toward the target point P2 in the first forward movement step S10 and then rotate by a predetermined angle in the first rotation step S20 (see FIGS. 11B and 13B).

Specifically, in the first rotation step S20, the robot cleaner 1 may rotate in a stationary state on the floor surface. That is, in the first rotation step S20, the control part 110 may control the first motor 56 and the second motor 57 so that the first motor 56 and the second motor 57 operate in the same direction. In this case, the pair of rotary plates 10 and 20 may rotate in the same direction. Therefore, the first mop 30 and the second mop 40 may rotate in the same direction.

For example, in order to rotate the robot cleaner 1 counterclockwise when viewed from the top side perpendicular to the ground surface (floor surface), the control part 110 may operate the first motor 56 and the second motor 57 to rotate the first rotary plate 10 and the second rotary plate 20 clockwise. Therefore, the first mop 30 and the second mop 40 rotate clockwise together with the first rotary plate 10 and the second rotary plate and relatively rotate while generating friction with the floor surface B, thereby rotating the robot cleaner 1 counterclockwise.

As another example, in order to rotate the robot cleaner 1 clockwise when viewed from the top side perpendicular to the ground surface (floor surface), the control part 110 may operate the first motor 56 and the second motor 57 to rotate the first rotary plate 10 and the second rotary plate 20 counterclockwise. Therefore, the first mop 30 and the second mop 40 rotate counterclockwise together with the first rotary plate 10 and the second rotary plate 20 and relatively rotate while generating friction with the floor surface B, thereby rotating the robot cleaner 1 clockwise.

In the first rotation step S20, the control part 110 may rotate the pair of rotary plates 10 and 20 at the same velocity (ω1=ω2) at the time of initiating the rotation. That is, in the first rotation step S20, the control part 110 may operate the first motor 56 and the second motor 57 with the same output. Further, in the first rotation step S20, the relative movement velocity v1 of the first mop 30 to the floor surface B may be equal in magnitude (absolute value) to the relative movement velocity v2 of the second mop 40 to the floor surface B.

On the contrary, in the first rotation step S20, the robot cleaner 1 may rotate while moving on the floor surface. That is, in the first rotation step S20, the control part 110 may control the first motor 56 and the second motor 57 to rotate the pair of rotary plates 10 and 20 in opposite directions or the same direction in such a way that the rotational velocities of the pair of rotary plates 10 and 20 are different from each other. In this case, the robot cleaner 1 may rotate while forming an arc on the floor surface.

In the first rotation step S20, the robot cleaner 1 may be rotated by a predetermined first rotation angle α.

For example, in the first rotation step S20, the robot cleaner 1 may be rotated toward the starting point P1. In this case, the front surface 51 of the main body 50 may be directed toward a portion distant from the target point P2. In particular, when the rotation angle of the main body 50 is 180 degrees, the front surface 51 of the main body 50 may be directed toward the starting point P1 (see FIG. 11B).

As another example, based on the direction in which the front surface 51 of the main body 50 of the robot cleaner 1 is directed in the first forward movement step S10, the main body 50 of the robot cleaner 1 may be rotated by an angle of more than 90 degrees and 180 degrees or less in the first rotation step S20. In this case, the front surface 51 of the main body 50 may be directed toward a portion distant from the target point P2 (see FIG. 13B).

In the second forward movement step S30, the robot cleaner 1 may move forward after the first rotation step S20 (see FIGS. 11C and 13C).

In the second forward movement step S30, the robot cleaner 1 may move forward by a predetermined second forward movement distance D2.

For example, in the second forward movement step S30, the robot cleaner 1 may rectilinearly move forward by the second forward movement distance D2. In this case, the first rotary plate 10 and the second rotary plate 20 may be rotated in opposite directions, and a rotational velocity ω1 of the first rotary plate 10 and a rotational velocity ω2 of the second rotary plate 20 may be equal to each other (ω1=ω2). That is, in the second forward movement step S30, the control part 110 may operate the first motor 56 and the second motor 57 with the same output. Further, in the second forward movement step S30, a relative movement velocity v1 of the first mop 30 to the floor surface B may be equal to a relative movement velocity v2 of the second mop 40 to the floor surface B (v1=v2).

As another example, in the second forward movement step S30, the robot cleaner 1 may move forward while forming a curved trajectory having a predetermined curvature on the floor surface. That is, in the second forward movement step S30, the robot cleaner 1 may move forward toward the target point P2 while forming a curved trajectory having a predetermined curvature on the floor surface. That is, the first rotary plate 10 and the second rotary plate 20 may rotate in opposite directions in such a way that the rotational velocities of the first rotary plate 10 and the second rotary plate 20 are different from each other. In this case, a difference (ω1−ω2=□ω) in rotational velocities between the first rotary plate 10 and the second rotary plate 20 may be constant. With the above-mentioned configuration, the robot cleaner 1 may clean a broader region in comparison with the case in which the robot cleaner moves rectilinearly.

Meanwhile, the second forward movement distance D2 may be shorter than the first forward movement distance D1 (D2<D1). Therefore, a distance from the starting point P1 to a position of the robot cleaner 1 at a point in time at which the second forward movement step S30 is ended may be shorter than a distance from the starting point P1 to a position of the robot cleaner 1 at a point in time at which the first forward movement step S10 is ended.

Therefore, the robot cleaner 1 moves forward in the first forward movement step S10, rotates in the first rotation step S20, and then moves forward in the second forward movement step S30.

In this case, in the second forward movement step S30, the robot cleaner 1 may move forward in the direction in which the robot cleaner moves away from the target point P2. In this case, a region in which the robot cleaner 1 moves on the floor surface B in the first forward movement step S10 may at least partially overlap a region in which the robot cleaner 1 moves on the floor surface B in the second forward movement step S30.

For example, in the second forward movement step S30, the robot cleaner 1 may move forward toward the starting point P1. That is, in the second forward movement step S30, the robot cleaner 1 may move forward along the route along which the robot cleaner 1 has moved in the first forward movement step S10 (see FIG. 11C).

As another example, in the second forward movement step S30, the robot cleaner 1 may move forward in a diagonal direction when viewed from the starting point P1. That is, the route along which the robot cleaner 1 moves forward in the second forward movement step S30 may make a predetermined angle with the route along which the robot cleaner 1 moves in the first forward movement step S10 (see FIG. 13C).

In the second rotation step S40, the control part 110 may rotate the robot cleaner 1. That is, the robot cleaner 1 may move forward in the second forward movement step S30 and then rotate by a predetermined angle in the second rotation step S40.

Specifically, in the second rotation step S40, the robot cleaner 1 may rotate in a stationary state on the floor surface. That is, in the second rotation step S40, the control part 110 may control the first motor 56 and the second motor 57 so that the first motor 56 and the second motor 57 operate in the same direction. In this case, the pair of rotary plates 10 and 20 may rotate in the same direction. Therefore, the first mop 30 and the second mop 40 may rotate in the same direction.

In the second rotation step S40, the control part 110 may rotate the pair of rotary plates 10 and 20 at the same velocity (ω1=ω2) at the time of initiating the rotation. That is, in the second rotation step S40, the control part 110 may operate the first motor 56 and the second motor 57 with the same output. Further, in the second rotation step S40, the relative movement velocity v1 of the first mop 30 to the floor surface B may be equal in magnitude (absolute value) to the relative movement velocity v2 of the second mop 40 to the floor surface B.

On the contrary, in the second rotation step S40, the robot cleaner 1 may rotate while moving on the floor surface. That is, in the second rotation step S40, the control part 110 may control the first motor 56 and the second motor 57 to rotate the pair of rotary plates 10 and 20 in opposite directions or the same direction in such a way that the rotational velocities of the pair of rotary plates 10 and 20 are different from each other. In this case, the robot cleaner 1 may rotate while forming an arc on the floor surface.

In the second rotation step S40, the robot cleaner 1 may be rotated by a predetermined second rotation angle β.

For example, in the second rotation step S40, the robot cleaner 1 may be rotated toward the target point P2. In this case, the front surface 51 of the main body 50 may be directed toward a portion distant from the starting point P1. In particular, when the rotation angle of the main body 50 is 180 degrees, the front surface 51 of the main body 50 may be directed toward the target point P2 (see FIG. 11D).

As another example, based on the direction in which the front surface 51 of the main body 50 of the robot cleaner 1 is directed in the first forward movement step S10, the main body 50 of the robot cleaner 1 may be rotated by an angle of more than 90 degrees and 180 degrees or less in the second rotation step S40. In this case, the front surface 51 of the main body 50 may be directed toward a portion distant from the starting point P1 (see FIG. 13D).

Meanwhile, the first rotation angle α and the second rotation angle β may be equal in magnitude to each other. Further, the first rotation angle α and the second rotation angle β may be opposite in rotation direction to each other.

For example, the robot cleaner 1 may rotate clockwise by 180 degrees in the first rotation step S20, and the robot cleaner 1 may rotate counterclockwise by 180 degrees in the second rotation step S40. As a result, after the second rotation step S40 is ended, the front surface 51 of the main body 50 may be directed toward the target point P2.

With the above-mentioned configuration, the robot cleaner 1 may move along an imaginary straight route connecting the starting point P1 and the target point P2 and repeatedly clean the cleaning region only by moving forward, thereby improving the effect of cleaning the floor surface (see FIG. 11D).

The is derived from the fact that no sensor for recognizing an obstacle is provided on the rear surface of the robot cleaner or the number of sensors is significantly smaller than the number of sensors provided on the front surface of the robot cleaner even though the robot cleaner has the sensor. In comparison with the case in which the robot cleaner cleans the floor surface while moving rearward, it is possible to prevent a collision of and damage to the robot cleaner.

As another example, the robot cleaner 1 may rotate clockwise by an angle of more than 90 degrees and less than 180 degrees in the first rotation step S20, and the robot cleaner 1 may rotate counterclockwise by an angle of more than 90 degrees and less than 180 degrees in the second rotation step S40. As a result, after the second rotation step S40 is ended, the direction in which the front surface 51 of the main body 50 is directed may be parallel to the direction in which the front surface 51 of the main body 50 is directed in the first forward movement step S10 (see FIG. 13D).

Therefore, the robot cleaner 1 may repeatedly clean a broader area while moving toward the target point P2.

Meanwhile, the method of controlling the robot cleaner according to the embodiment of the present disclosure may further include a third forward movement step S50, a third rotation step S60, a fourth forward movement step S70, and a fourth rotation step S80 (see FIGS. 11E and 13E).

Meanwhile, in the case in which the robot cleaner 1 rotates by 180 degrees in the first rotation step S20 and the second rotation step S40, the third forward movement step S50, the third rotation step S60, the fourth forward movement step S70, and the fourth rotation step S80 are identical to the first forward movement step S10, the first rotation step S20, the second forward movement step S30, and the second rotation step S40, respectively. Therefore, the description of the third forward movement step S50, the third rotation step S60, the fourth forward movement step S70, and the fourth rotation step S80 may be replaced with the description of the first forward movement step S10, the first rotation step S20, the second forward movement step S30, and the second rotation step S40.

Therefore, the configuration in which the robot cleaner 1 rotates by an angle of more than 90 degrees and less than 180 degrees in the first rotation step S20 and the second rotation step S40 will be described below.

In the third forward movement step S50, the robot cleaner 1 may move forward after the second rotation step S40.

When the control part 110 starts the forward movement, the control part 110 may rotate the first motor 56 and the second motor 57 in opposite directions. That is, the first rotary plate 10 and the second rotary plate 20 may rotate in opposite directions.

In the third forward movement step S50, the robot cleaner 1 may move forward by a predetermined third forward movement distance D3.

For example, in the third forward movement step S50, the robot cleaner 1 may rectilinearly move forward by the third forward movement distance D3. In this case, the first rotary plate 10 and the second rotary plate 20 may be rotated in opposite directions, and a rotational velocity $\omega 1$ of the first rotary plate 10 and a rotational velocity $\omega 2$ of the second rotary plate 20 may be equal to each other ($\omega 1=\omega 2$). That is, in the third forward movement step S50, the control part 110 may operate the first motor 56 and the second motor 57 with the same output. Further, in the third forward movement step S50, a relative movement velocity v1 of the first mop 30 to the floor surface B may be equal to a relative movement velocity v2 of the second mop 40 to the floor surface B (v1=v2).

As another example, in the third forward movement step S50, the robot cleaner 1 may move forward while forming a curved trajectory having a predetermined curvature on the floor surface. That is, the first rotary plate 10 and the second rotary plate 20 may rotate in opposite directions in such a way that the rotational velocities of the first rotary plate 10 and the second rotary plate 20 are different from each other. In this case, a difference ($\omega 1-\omega 2=\square\omega$) in rotational velocities between the first rotary plate 10 and the second rotary plate 20 may be constant. With the above-mentioned configuration, the robot cleaner 1 may clean a broader region in comparison with the case in which the robot cleaner moves rectilinearly.

Meanwhile, the third forward movement distance D3 may be longer than the second forward movement distance D2 (D3>D2). Therefore, a distance from the starting point P1 to a position of the robot cleaner 1 at a point in time at which the third forward movement step S50 is ended may be longer than a distance from the starting point P1 to a position of the robot cleaner 1 at a point in time at which the second forward movement step S30 is ended. In addition, the distance from the starting point P1 to the position of the robot cleaner 1 at the point in time at which the third forward movement step S50 is ended may be longer than a distance from the starting point P1 to a position of the robot cleaner 1 at a point in time at which the first forward movement step S10 is ended.

Therefore, a region in which the robot cleaner 1 moves on the floor surface B in the third forward movement step S50 may at least partially overlap a region in which the robot cleaner 1 moves on the floor surface B in the second forward movement step S30. In addition, the region in which the robot cleaner 1 moves on the floor surface B in the third forward movement step S50 may at least partially overlap a region in which the robot cleaner 1 moves on the floor surface B in the first forward movement step S10.

For example, in the third forward movement step S50, the robot cleaner 1 may move forward along a route parallel to the route along which the robot cleaner 1 has moved in the first forward movement step S10. In this case, the region in which the robot cleaner 1 moves may at least partially overlap the region in which the robot cleaner 1 has moved on the floor surface B in the first forward movement step S10. In addition, in the third forward movement step S50, the robot cleaner 1 may move forward along a route making a predetermined angle with the route in which the robot cleaner 1 has moved in the second forward movement step S30. In this case, the region in which the robot cleaner 1 moves may at least partially overlap the region in which the robot cleaner 1 has moved on the floor surface B in the second forward movement step S30.

In the third rotation step S60, the robot cleaner 1 may be rotated after the third forward movement step S50. That is, the robot cleaner 1 may move forward in the third forward movement step S50 and then rotate by a predetermined angle in the third rotation step S60 (see FIG. 13F).

Specifically, in the third rotation step S60, the robot cleaner 1 may rotate in a stationary state on the floor surface. That is, in the third rotation step S60, the control part 110 may control the first motor 56 and the second motor 57 so that the first motor 56 and the second motor 57 operate in the same direction. In this case, the pair of rotary plates 10 and 20 may rotate in the same direction. Therefore, the first mop 30 and the second mop 40 may rotate in the same direction.

In the third rotation step S60, the control part 110 may rotate the pair of rotary plates 10 and 20 at the same velocity ($\omega 1=\omega 2$) at the time of initiating the rotation. That is, in the third rotation step S60, the control part 110 may operate the first motor 56 and the second motor 57 with the same output. Further, in the third rotation step S60, the relative movement velocity v1 of the first mop 30 to the floor surface B may be equal in magnitude (absolute value) to the relative movement velocity v2 of the second mop 40 to the floor surface B.

On the contrary, in the third rotation step S60, the robot cleaner 1 may rotate while moving on the floor surface. That is, in the third rotation step S60, the control part 110 may control the first motor 56 and the second motor 57 to rotate the pair of rotary plates 10 and 20 in opposite directions or the same direction in such a way that the rotational velocities of the pair of rotary plates 10 and 20 are different from each other. In this case, the robot cleaner 1 may rotate while forming an arc on the floor surface.

In the third rotation step S60, the robot cleaner 1 may be rotated by a predetermined third rotation angle γ.

For example, in the third rotation step S60, the robot cleaner 1 may be rotated toward the starting point P1. That is, based on the direction in which the front surface 51 of the main body 50 of the robot cleaner 1 is directed in the third forward movement step S50, the main body 50 of the robot cleaner 1 may be rotated by an angle of more than 90 degrees and less than 180 degrees in the third rotation step S60. In this case, the front surface 51 of the main body 50 may be directed toward a portion distant from the target point P2.

Meanwhile, the third rotation angle γ and the second rotation angle β are equal in magnitude and rotation direction to each other. For example, the robot cleaner 1 may rotate counterclockwise by an angle of more than 90 degrees and less than 180 degrees in the second rotation step S40, and the robot cleaner 1 may also rotate counterclockwise by an angle of more than 90 degrees and less than 180 degrees in the third rotation step S60.

In addition, the third rotation angle γ and the first rotation angle α may be equal in magnitude to each other. Further, the third rotation angle γ and the first rotation angle α may be opposite in rotation direction to each other. For example, the robot cleaner 1 may rotate clockwise by an angle of more than 90 degrees and less than 180 degrees in the first rotation step S20, and the robot cleaner 1 may rotate counterclockwise by an angle of more than 90 degrees and less than 180 degrees in the third rotation step S60.

With this configuration, it is possible to prevent the robot cleaner 1 from deviating in any one direction from a straight line connecting the starting point P1 and the target point P2.

In addition, based on the centerline, which is an imaginary line connecting the starting point P1 and the target point P2 on the floor surface, it is possible to uniformly clean the region in predetermined leftward and rightward ranges of the centerline.

In the fourth forward movement step S70, the robot cleaner 1 may move forward after the third rotation step S60 (see FIG. 13G).

When the control part 110 starts the forward movement, the control part 110 may rotate the first motor 56 and the second motor 57 in opposite directions. That is, the first rotary plate 10 and the second rotary plate 20 may rotate in opposite directions.

In the fourth forward movement step S70, the robot cleaner 1 may move forward by a predetermined fourth forward movement distance D4.

For example, in the fourth forward movement step S70, the robot cleaner 1 may rectilinearly move forward by the fourth forward movement distance D4. In this case, the first rotary plate 10 and the second rotary plate 20 may be rotated in opposite directions, and a rotational velocity ω1 of the first rotary plate 10 and a rotational velocity ω2 of the second rotary plate 20 may be equal to each other (ω1=ω2). T As another example, in the fourth forward movement step S70, the robot cleaner 1 may move forward while forming a curved trajectory having a predetermined curvature on the floor surface. That is, in the fourth forward movement step S70, the robot cleaner 1 may move forward while forming a curved trajectory having a predetermined curvature on the floor surface. That is, the first rotary plate 10 and the second rotary plate 20 may rotate in opposite directions in such a way that the rotational velocities of the first rotary plate 10 and the second rotary plate 20 are different from each other. In this case, a difference (ω1−ω2=□ω) in rotational velocities between the first rotary plate 10 and the second rotary plate 20 may be constant.

Meanwhile, the fourth forward movement distance D4 may be shorter than the third forward movement distance D3 (D4<D3). Therefore, a distance from the starting point P1 to a position of the robot cleaner 1 at a point in time at which the fourth forward movement step S70 is ended may be shorter than a distance from the starting point P1 to a position of the robot cleaner 1 at a point in time at which the third forward movement step S50 is ended.

Therefore, a region in which the robot cleaner 1 moves on the floor surface B in the fourth forward movement step S70 may at least partially overlap a region in which the robot cleaner 1 moves on the floor surface B on the third forward movement step S50. In addition, the region in which the robot cleaner 1 moves on the floor surface B in the fourth forward movement step S70 may at least partially overlap a region in which the robot cleaner 1 moves on the floor surface B in the second forward movement step S30. Further, the region in which the robot cleaner 1 moves on the floor surface B in the fourth forward movement step S70 may at least partially overlap a region in which the robot cleaner 1 moves on the floor surface B in the first forward movement step S10.

For example, in the fourth forward movement step S70, the robot cleaner 1 may move forward along a route making a predetermined angle with the route in which the robot cleaner 1 has moved in the first forward movement step S10. In this case, the region in which the robot cleaner 1 moves may at least partially overlap the region in which the robot cleaner 1 has moved on the floor surface B in the first forward movement step S10. In addition, in the fourth forward movement step S70, the robot cleaner 1 may move forward along a route making a predetermined angle with the route in which the robot cleaner 1 has moved in the second forward movement step S30. In this case, the region in which the robot cleaner 1 moves may at least partially overlap the region in which the robot cleaner 1 has moved on the floor surface B in the second forward movement step S30. In addition, in the fourth forward movement step S70, the robot cleaner 1 may move forward along a route making a predetermined angle with the route in which the robot cleaner 1 has moved in the third forward movement step S50. In this case, the region in which the robot cleaner 1 moves may at least partially overlap the region in which robot cleaner 1 has moved on the floor surface B in the third forward movement step S50.

In the fourth rotation step S80, the control part 110 may rotate the robot cleaner 1. That is, the robot cleaner 1 may move forward in the fourth forward movement step S70 and then rotate by a predetermined angle in the fourth rotation step S80 (see FIG. 13H).

Specifically, in the fourth rotation step S80, the robot cleaner 1 may rotate in a stationary state on the floor surface. That is, in the fourth rotation step S80, the control part 110 may control the first motor 56 and the second motor 57 so that the first motor 56 and the second motor 57 operate in the same direction. In this case, the pair of rotary plates 10 and 20 may rotate in the same direction. Therefore, the first mop 30 and the second mop 40 may rotate in the same direction.

In the fourth rotation step S80, the control part 110 may rotate the pair of rotary plates 10 and 20 at the same velocity ($\omega 1=\omega 2$) at the time of initiating the rotation. That is, in the second rotation step S40, the control part 110 may operate the first motor 56 and the second motor 57 with the same output. Further, in the second rotation step S40, the relative movement velocity v1 of the first mop 30 to the floor surface B may be equal in magnitude (absolute value) to the relative movement velocity v2 of the second mop 40 to the floor surface B.

On the contrary, in the fourth rotation step S80, the robot cleaner 1 may rotate while moving on the floor surface. That is, in the second rotation step S40, the control part 110 may control the first motor 56 and the second motor 57 to rotate the pair of rotary plates 10 and 20 in opposite directions or the same direction in such a way that the rotational velocities of the pair of rotary plates 10 and 20 are different from each other. In this case, the robot cleaner 1 may move while forming an arc on the floor surface.

In the fourth rotation step S80, the robot cleaner 1 may be rotated by a predetermined fourth rotation angle $\delta$.

For example, in the fourth rotation step S80, the robot cleaner 1 may be rotated toward the target point P2. That is, based on the direction in which the front surface 51 of the main body 50 of the robot cleaner 1 is directed in the fourth forward movement step S70, the main body 50 of the robot cleaner 1 may be rotated by an angle of more than 90 degrees and less than 180 degrees in the fourth rotation step S80. In this case, the front surface 51 of the main body 50 may be directed toward a portion distant from the starting point P1.

Meanwhile, the third rotation angle $\gamma$ and the fourth rotation angle & may be equal in magnitude to each other. Further, the third rotation angle $\gamma$ and the fourth rotation angle $\delta$ may be opposite in rotation direction to each other. For example, the robot cleaner 1 may rotate clockwise by an angle of more than 90 degrees and less than 180 degrees in the third rotation step S60, and the robot cleaner 1 rotates counterclockwise by an angle of more than 90 degrees and less than 180 degrees in the fourth rotation step S80. As a result, after the fourth rotation step S80 is ended, a direction in which the front surface 51 of the main body 50 is directed may be parallel to a direction in which the front surface 51 of the main body 50 is directed in the third forward movement step S50. In addition, after the fourth rotation step S80 is ended, a direction in which the front surface 51 of the main body 50 is directed may be identical to a direction in which the front surface 51 of the main body 50 is directed in the first forward movement step S10.

Meanwhile, the method of controlling the robot cleaner according to the embodiment of the present disclosure may repeat the first forward movement step S10, the first rotation step S20, the second forward movement step S30, the second rotation step S40, the third forward movement step S50, the third rotation step S60, the fourth forward movement step S70, and the fourth rotation step S80 until the robot cleaner 1 reaches the target point P2 or the robot cleaner 1 passes through the target point P2.

An effect of the method of controlling the robot cleaner according to the embodiment of the present disclosure will be described below.

According to the method of controlling the robot cleaner according to the embodiment of the present disclosure, the main body 50 of the robot cleaner 1 may move forward toward the target point P2, rotate, move forward again, and then rotate toward the target point P2. Therefore, the robot cleaner 1 may repeatedly clean the floor surface B only by moving forward.

Therefore, the severely contaminated floor surface may be precisely cleaned.

In addition, the main body 50 may move forward toward the target point P2 by the predetermined first forward movement distance D1, rotate, and then move forward again by the predetermined second forward movement distance D2. In this case, since the first forward movement distance D1 is longer than the second forward movement distance D2, the main body 50 may repeatedly clean the floor surface B while gradually moving toward the target point P2.

Therefore, because the forward direction coincides with the direction of the final target point, it is possible to reduce the time required to move the robot cleaner and perform the cleaning operation.

In addition, the main body 50 may move forward toward the target point P2, rotate by the predetermined first rotation angle $\alpha$, move forward again, and then rotate by the predetermined second rotation angle $\beta$. The first rotation angle $\alpha$ and the second rotation angle $\beta$ may be equal in magnitude to each other but opposite in rotation direction to each other. Therefore, in a state in which the robot cleaner 1 rotates an even number of times, a direction in which the front surface 51 of the main body 50 is directed may be identical or parallel to the direction in which the front surface 51 of the main body 50 is directed in the first forward movement step S10. Therefore, the main body 50 may finally reach the target point P2 even though the robot cleaner 1 rotates multiple times.

In addition, the main body 50 may rotate by the second rotation angle $\beta$, move forward, rotate by the predetermined third rotation angle $\gamma$, and then move forward. The third rotation angle $\gamma$ may be equal in magnitude and rotation direction to the second rotation angle. The third rotation angle $\gamma$ may be equal in magnitude to the first rotation angle $\alpha$ but opposite in rotation direction to the first rotation angle $\alpha$. Therefore, a leftward/rightward direction movement range of the robot cleaner 1 may be maintained in a predetermined distance range.

In addition, the main body 50 moves from the starting point P1 to the target point P2 while repeatedly moving forward and rotating. The regions in which the pair of rotary plates 10 and 20 or the pair of mops 30 and 40 comes into contact with the floor surface B while the main body 50 moves may at least partially overlap. Therefore, the robot cleaner 1 repeatedly moves in the cleaning region, thereby improving the cleaning effect.

While the present disclosure has been described with reference to the specific embodiments, the specific embodiments are only for specifically explaining the present disclosure, and the present disclosure is not limited to the specific embodiments. It is apparent that the present disclosure may be modified or altered by those skilled in the art without departing from the technical spirit of the present disclosure.

All the simple modifications or alterations to the present disclosure fall within the scope of the present disclosure, and the specific protection scope of the present disclosure will be defined by the appended claims.

The invention claimed is:

1. A robot cleaner configured to move based on a centerline, which is an imaginary line connecting from a starting point and to a predetermined target point on a floor surface, the robot cleaner comprising:

a main body having a bumper provided on a front surface thereof and having a space for accommodating a battery, a water container, and a motor therein; and a pair of rotary plates rotatably disposed on a bottom surface of the main body and having lower sides to which mops facing the floor surface are coupled, wherein the main body moves forward toward the target point, rotates by a predetermined first rotation angle, moves forward again, rotates by a predetermined second rotation angle, moves forward, rotates by a predetermined third rotation angle, and then moves forward, wherein the first rotation angle and the second rotation angle are equal in magnitude to each other and opposite in rotation direction to each other, wherein the first rotation angle and the third rotation angle are equal in magnitude to each other and opposite in rotation direction to each other, wherein the second rotation angle and the third rotation angle are equal in magnitude and rotation direction to each other, wherein a forward movement and rotation cause the main body to temporarily deviate from the centerline connecting the starting point and the target point, and wherein the main body subsequently progresses toward the target point while maintaining an overall alignment with the centerline without executing backward movement.

2. The robot cleaner of claim 1, wherein the main body moves forward toward the target point by a predetermined first forward movement distance, rotates, and then moves forward again by a predetermined second forward movement distance, and wherein the first forward movement distance is longer than the second forward movement distance.

3. The robot cleaner of claim 1, wherein the main body moves forward toward the target point while forming a curved trajectory having a predetermined curvature on the floor surface.

4. The robot cleaner of claim 1, wherein the main body stops moving for a predetermined stop time while moving forward toward the target point.

5. The robot cleaner of claim 1, wherein the main body moves forward toward the target point and then rotates toward the starting point.

6. The robot cleaner of claim 1, wherein the main body rotates by an angle of more than 90 degrees and 180 degrees or less based on a direction in which the main body moves forward.

7. The robot cleaner of claim 1, wherein the main body moves from the starting point to the target point while repeatedly moving forward and rotating, and regions in which the main body moves on the floor surface at least partially overlap.

* * * * *